US008944932B2

(12) United States Patent
Sato et al.

(10) Patent No.: US 8,944,932 B2
(45) Date of Patent: Feb. 3, 2015

(54) SWING ANALYZER

(75) Inventors: Fuminobu Sato, Osaka (JP); Hiroshi Nagao, Osaka (JP); Takashi Kimura, Osaka (JP)

(73) Assignee: Mizuno Corporation, Osaka (JP)

( * ) Notice: Subject to any disclaimer, the term of this patent is extended or adjusted under 35 U.S.C. 154(b) by 703 days.

(21) Appl. No.: 12/414,490

(22) Filed: Mar. 30, 2009

(65) Prior Publication Data

US 2009/0247312 A1 Oct. 1, 2009

(30) Foreign Application Priority Data

Mar. 31, 2008 (JP) ..... 2008-093427

(51) Int. Cl.
*A63B 69/36* (2006.01)

(52) U.S. Cl.
CPC ..... *A63B 69/3632* (2013.01); *A63B 2220/10* (2013.01); *A63B 2220/40* (2013.01); *A63B 2220/54* (2013.01); *A63B 2220/833* (2013.01)
USPC ..... 473/223; 473/226; 473/233

(58) Field of Classification Search
USPC ..... 473/200
See application file for complete search history.

(56) References Cited

U.S. PATENT DOCUMENTS 5,233,544 A * 8/1993 Kobayashi ..... 702/141
5,688,183 A * 11/1997 Sabatino et al. ..... 473/212
6,000,286 A * 12/1999 Naruo et al. ..... 73/491
6,003,368 A * 12/1999 Naruo et al. ..... 73/489
6,014,887 A * 1/2000 Naruo et al. ..... 73/12.04
6,041,651 A * 3/2000 Naruo et al. ..... 73/491
6,224,493 B1 * 5/2001 Lee et al. ..... 473/223
6,441,745 B1 * 8/2002 Gates ..... 340/669
6,607,450 B1 * 8/2003 Hackman ..... 473/223
7,171,331 B2 * 1/2007 Vock et al. ..... 702/160
7,174,277 B2 * 2/2007 Vock et al. ..... 702/188
7,353,136 B2 * 4/2008 Vock et al. ..... 702/173
7,353,137 B2 * 4/2008 Vock et al. ..... 702/173
7,552,031 B2 * 6/2009 Vock et al. ..... 702/188
7,620,520 B2 * 11/2009 Vock et al. ..... 702/173
7,627,451 B2 * 12/2009 Vock et al. ..... 702/178
7,771,263 B2 * 8/2010 Telford ..... 463/3

(Continued)

FOREIGN PATENT DOCUMENTS

JP 62047557 3/1987
JP 62047557 A 3/1987

(Continued)

OTHER PUBLICATIONS

Notice of Grounds of Rejection issued by Japanese Patent Office Jul. 3, 2012 for co-pending Japanese Application No. 2008 093427.
Office Action from Japanese Patent Office Dated Apr. 16, 2013 regarding co-pending Japanese Patent Application No. 2008-093427.

(Continued)

*Primary Examiner* — Bach Hoang
(74) *Attorney, Agent, or Firm* — Troutman Sanders, LLP; James E. Schutz; Daniel Sharpe

(57) ABSTRACT

A calculating unit of a swing analyzer calculates, assuming that a golf club is in a uniform circular motion about a virtual center of rotation O during a swing, a virtual speed Vh at a central point R of a golf club head, based on a distance between first and second acceleration sensors, a distance between the first acceleration sensor and the central point R of a golf club head and outputs from the first and second acceleration sensors, and calculates the speed of central point R of a golf club head utilizing the virtual speed Vh.

16 Claims, 20 Drawing Sheets

(56) References Cited

U.S. PATENT DOCUMENTS

| | | | | |
|---|---|---|---|---|
| 7,856,339 | B2 * | 12/2010 | Vock et al. | 702/173 |
| 7,887,440 | B2 * | 2/2011 | Wright et al. | 473/409 |
| 8,126,675 | B2 * | 2/2012 | Vock et al. | 702/150 |
| 8,280,681 | B2 * | 10/2012 | Vock et al. | 702/173 |
| 8,280,682 | B2 * | 10/2012 | Vock et al. | 702/178 |
| 8,374,825 | B2 * | 2/2013 | Vock et al. | 702/188 |
| 8,396,687 | B2 * | 3/2013 | Vock et al. | 702/178 |
| 8,428,904 | B2 * | 4/2013 | Vock et al. | 702/150 |
| 8,506,425 | B2 * | 8/2013 | Wright et al. | 473/409 |
| 8,688,406 | B2 * | 4/2014 | Vock et al. | 702/188 |
| 2002/0123386 | A1 * | 9/2002 | Perlmutter | 473/223 |
| 2003/0040380 | A1 * | 2/2003 | Wright et al. | 473/409 |
| 2005/0261073 | A1 * | 11/2005 | Farrington et al. | 473/221 |
| 2005/0288119 | A1 * | 12/2005 | Wang et al. | 473/223 |
| 2006/0052173 | A1 * | 3/2006 | Telford | 473/131 |

FOREIGN PATENT DOCUMENTS

| | | | |
|---|---|---|---|
| JP | 10328341 | A | 12/1988 |
| JP | 3-126477 | A | 5/1991 |
| JP | 6300771 | | 10/1994 |
| JP | 06300771 | A | 10/1994 |
| JP | 10-43349 | A | 2/1998 |
| JP | 10328341 | | 12/1998 |
| JP | 11-128430 | A | 5/1999 |
| JP | 2001-129145 | A | 5/2001 |
| JP | 2003284802 | | 10/2003 |
| JP | 2006289073 | A | 10/2006 |
| JP | 2007296204 | | 11/2007 |
| WO | 00/29075 | A | 5/2000 |

* cited by examiner

SWING ANALYZER

This nonprovisional application is based on Japanese Patent Application No. 2008-093427 filed with the Japan Patent Office on Mar. 31, 2008, the entire contents of which are hereby incorporated by reference.

BACKGROUND OF THE INVENTION

1. Field of the Invention

The present invention relates to a swing analyzer and, more specifically, to a swing analyzer capable of measuring swing speed of a portion as an object of measurement of a swing member.

2. Description of the Background Art

Conventionally, various swing analyzers measuring states of swings of golf or baseball batting have been proposed.

By way of example, Japanese Patent Laying-Open No. 3-126477 discloses a swing analyzing device including a swing implement having a shaft-like part, first and second two acceleration sensors arranged spaced apart by a distance on the shaft-like part with the direction of acceleration detection substantially matching axial line of the shaft-like part, and a translational acceleration sensor arranged spaced by a prescribed distance from the first and second acceleration sensors.

The motion of a player swinging the swing implement is regarded as a translational motion of two pendulums, that is, the arm of the player and the swing implement, and angular velocity of rotational motion of the swing member is calculated.

Specifically, angular velocity of rotational motion of the shaft is calculated using relational expressions of the distance between first and second acceleration sensors, translational acceleration and an angle of the direction of translational motion and the shaft, as well as the accelerations detected by the first, second and third acceleration sensors.

International publication WO2000/029075 discloses a golf swing frequency analyzer that measures acceleration of a golf club during a swing a number of times, calculates a maximum acceleration reference point and swing time from the data of acceleration, and from the swing time and the like, calculates a prescribed frequency. Based on the calculated frequency, a golf club having a desired vibration frequency is adapted to the golfer's swing.

The swing diagnostic equipment described in Japanese Patent Laying-Open No. 10-43349 includes an acceleration sensor attached to a back portion of a player's wrist, and the player's swing is analyzed based on an output from the acceleration sensor.

Japanese Patent Laying-Open No. 11-128430 proposes a golf club including an acceleration sensor provided inside a golf club, a light emitting diode or a semiconductor laser, and a control circuit.

Japanese Patent Laying-Open No. 2001-129145 proposes a swing training machine including, at a head of a bat or a golf club, an acceleration sensor for measuring acceleration in the axial direction of the bat or the like, an acceleration sensor for measuring acceleration in the tangential direction of circular motion, and an acceleration sensor for measuring acceleration in a direction orthogonal to the axial direction and the tangential direction, allowing measurement of a moment at which the head speed attains the highest.

SUMMARY OF THE INVENTION

An actual swing motion is not a simple double pendulum, and it involves, for example, rotation about a central axis of the shaft or deflection of shaft. Therefore, the shaft is in a very complicated motion during a swing.

According to Japanese Patent Laying-Open No. 3-126477, angular velocity of the shaft is calculated as (shaft rotation angle)=$((a1-a2)/d)^{1/2}$, where a1 represents an output of the first acceleration sensor, a2 represents an output of the second acceleration sensor, and d represents a distance between the first and second acceleration sensors. By the method described in Japanese Patent Laying-Open No. 3-126477, however, the angular velocity of the shaft in complicated motion cannot accurately be calculated.

In the golf swing frequency analyzer described in international publication W02000/029075, the swing speed of the golf club during a swing is not detected and, therefore, swing analysis based on the swing speed is impossible.

In the swing diagnostic equipment described in Japanese Patent Laying-Open No. 10-43349, swing speed during a swing cannot be calculated, and in the golf club described in Japanese Patent Laying-Open No. 11-128430, angular velocity of the golf club cannot accurately be calculated from the acceleration sensor or the control circuit incorporated in the golf club.

The swing speed training machine described in Japanese Patent Laying-Open No. 2001-129145 requires at least four acceleration sensors, and not the swing speed but only a moment (instant) at which the swing speed attains the highest is detected during a swing. It is disadvantageous in that the number of necessary acceleration meters is large and the cost of the apparatus itself is high.

The present invention was made in view of the foregoing, and its object is to provide a swing analyzer capable of calculating accurate swing speed with the cost of the analyzer itself reduced.

According to an aspect, the present invention provides a swing analyzer capable of outputting information that can be used for analyzing a swing of a user, including: first and second acceleration sensors provided on a swing member swung by a user and having a longitudinal direction, spaced apart by a distance in the longitudinal direction; a calculating unit capable of calculating speed of a portion as an object of measurement of the swing member, positioned apart from the first and second acceleration sensors in the longitudinal direction; and a display unit displaying a result of calculation. Assuming that the swing member is in circular motion during a swing, the calculating unit calculates a virtual speed at the portion as the object of measurement based on the distance between the first and second acceleration sensors, distance between the first acceleration sensor and the portion as the object of measurement and outputs from the first and second acceleration sensors, calculates speed of the portion as the object of measurement utilizing the virtual speed, and displays the speed on the display unit.

Preferably, the calculating unit stores in advance correction data calculated from the virtual speed and actual speed measured during a swing, for making equal or approximating the virtual speed to the actual speed; and the calculating unit calculates the speed of the portion as the object of measurement by correcting the virtual speed at the time of measurement using the correction data.

Preferably, the swing analyzer further includes an elastically deformable buffer member provided on a circumferential surface of the swing member, and a board provided on the buffer member. The first and second acceleration sensors are provided on a main surface of the board. Preferably, the swing analyzer further includes a strain gauge attached to the swing member, and the calculating unit calculates an amount of deflection of the swing member based on an output from the strain gauge.

By the swing analyzer in accordance with the present invention, the swing speed can accurately be calculated, and the manufacturing cost can be reduced.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

In the following, the swing analyzer in accordance with an embodiment of the present invention will be described.

Figure 1:
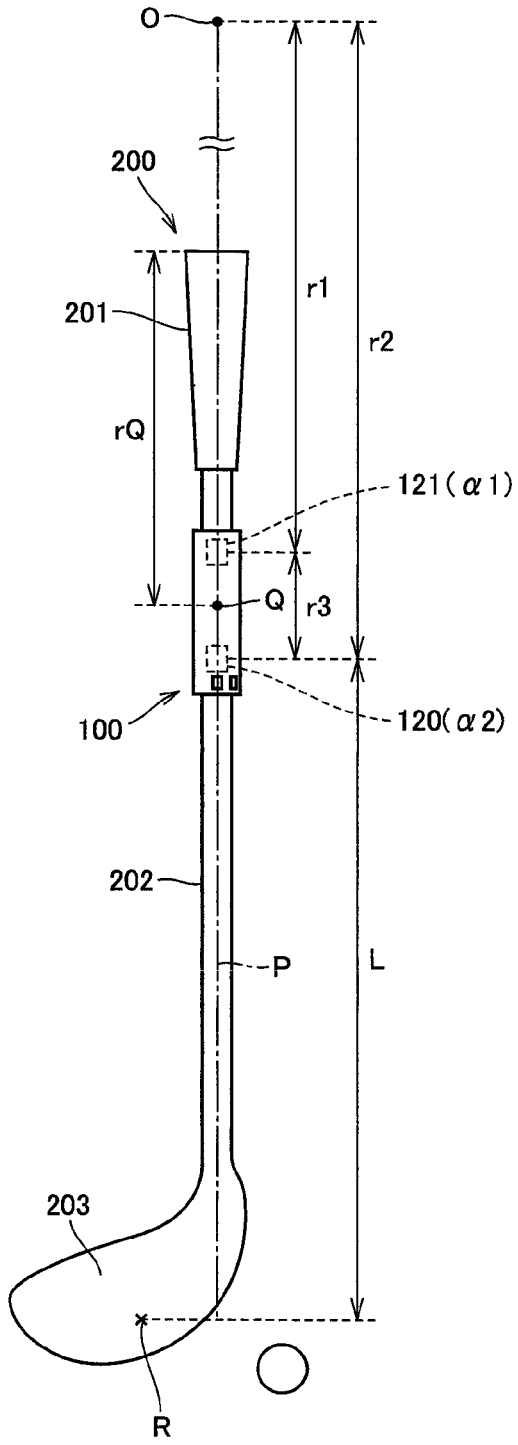
FIG. 1 is a front view of a measuring device mounted on a golf club.

FIG. 1 is a front view of a measuring device (swing analyzer) 100 attached to a golf club 200. As shown in FIG. 1, golf club 200 includes a grip 201 held by a golf player, a head 203 for hitting a ball, and a shaft 202 connecting grip 201 and head 203.

Measuring device 100 is mounted on shaft 202 such that center of gravity Q of measuring device 100 is positioned in a range of about 12 inches (about 304 mm) to about 15 inches (381 mm) from an upper end of golf club 200 (grip 201). By mounting measuring device 100 at such a position, significant variation in characteristic of golf club 200 before and after mounting measuring device 100 can be prevented.

Figure 2:
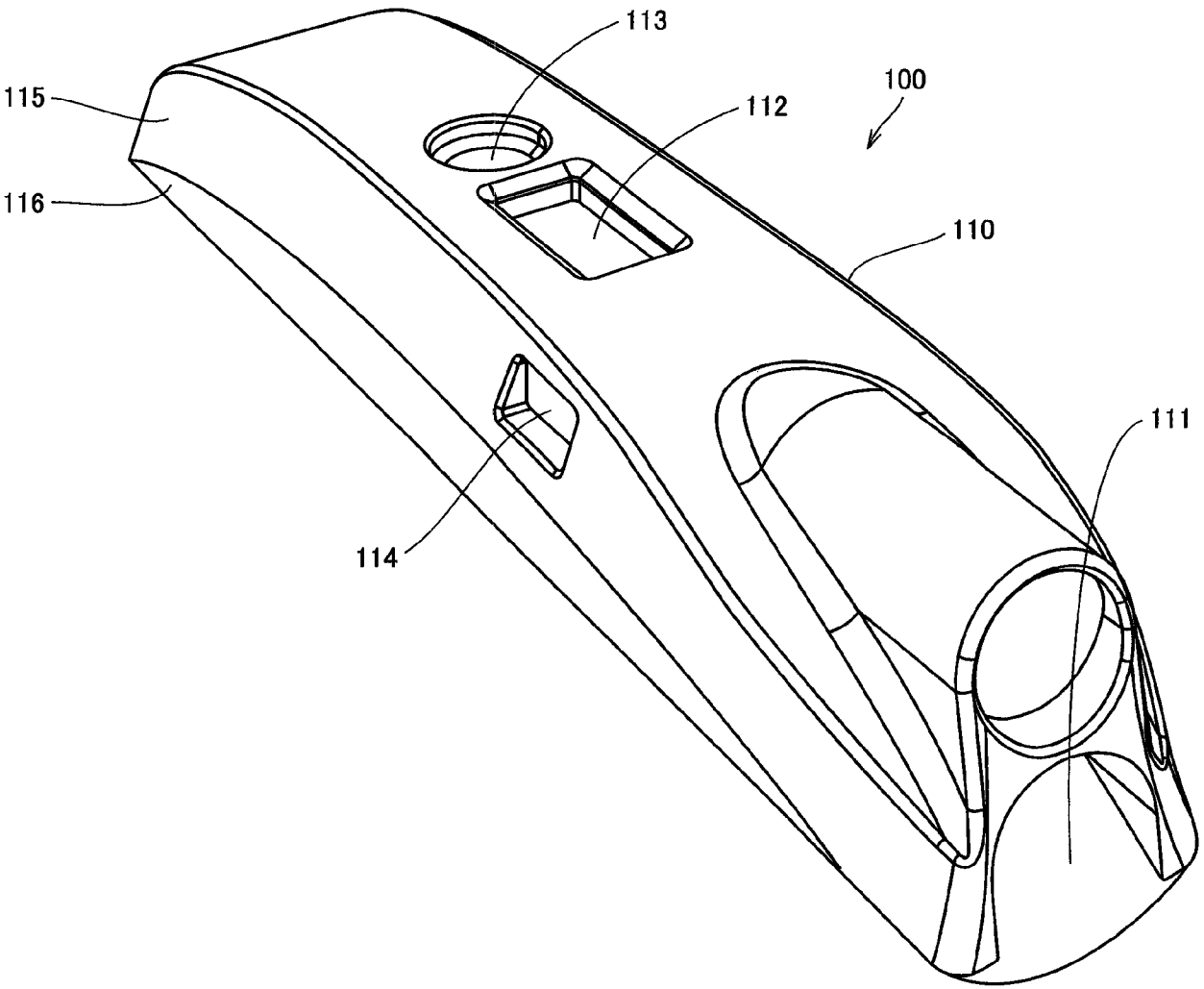
FIG. 2 is a perspective view of the measuring device.
Figure 3:
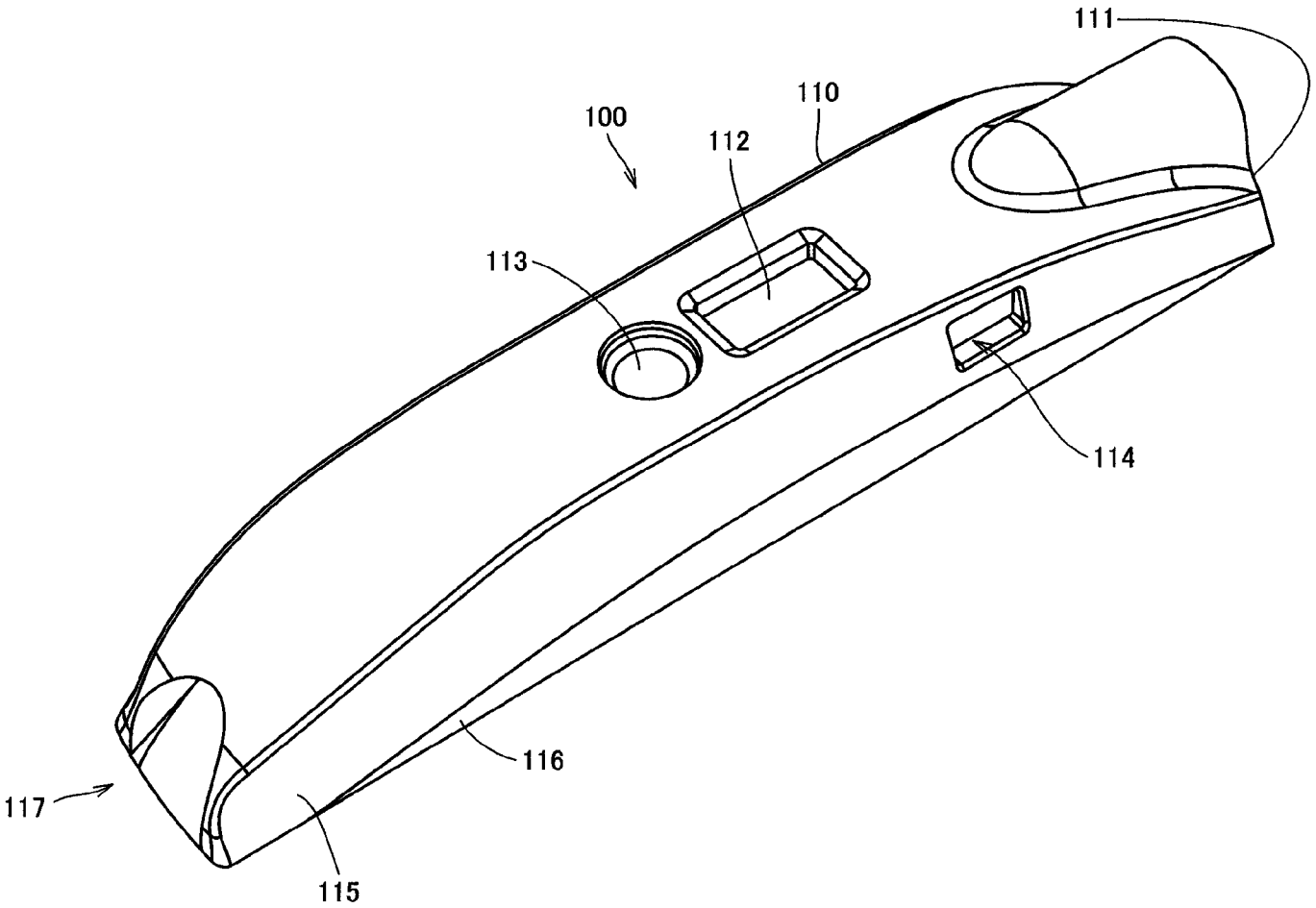
FIG. 3 is a perspective view of the measuring device.

FIGS. 2 and 3 are perspective views of measuring device 100. As shown in FIGS. 2 and 3, measuring device 100 includes a case 110 containing an acceleration sensor or the like therein, a display unit 112 displaying head speed and the like, a power switch 114 and a reset button 113. Case 110 includes an upper casing 115 and a lower casing 116, and by upper and lower casings 115 and 116, insertion holes 111 and 117 are defined, through which holes the shaft 202 of golf club 200 is inserted. Inner diameters of insertion holes 111 and 117 are formed to be larger than the outer diameter of shaft 202, so that even if shaft 202 should deflect during a swing, shaft 202 will not be in contact with inner circumferential surfaces of insertion holes 111 and 117.

Figure 4:
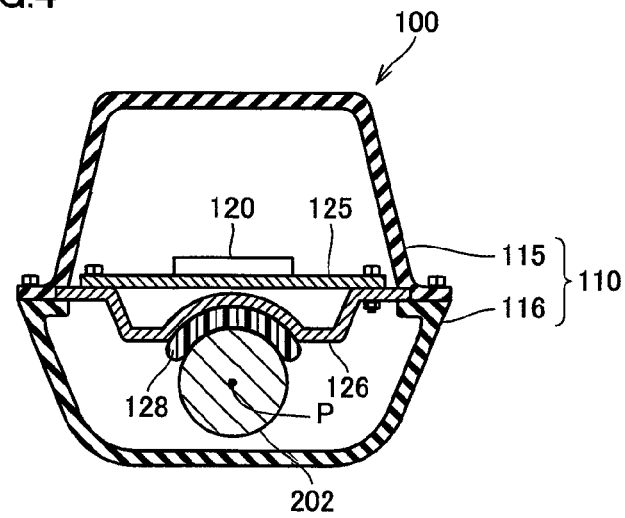
FIG. 4 is a cross-sectional view of the measuring device.
Figure 5:
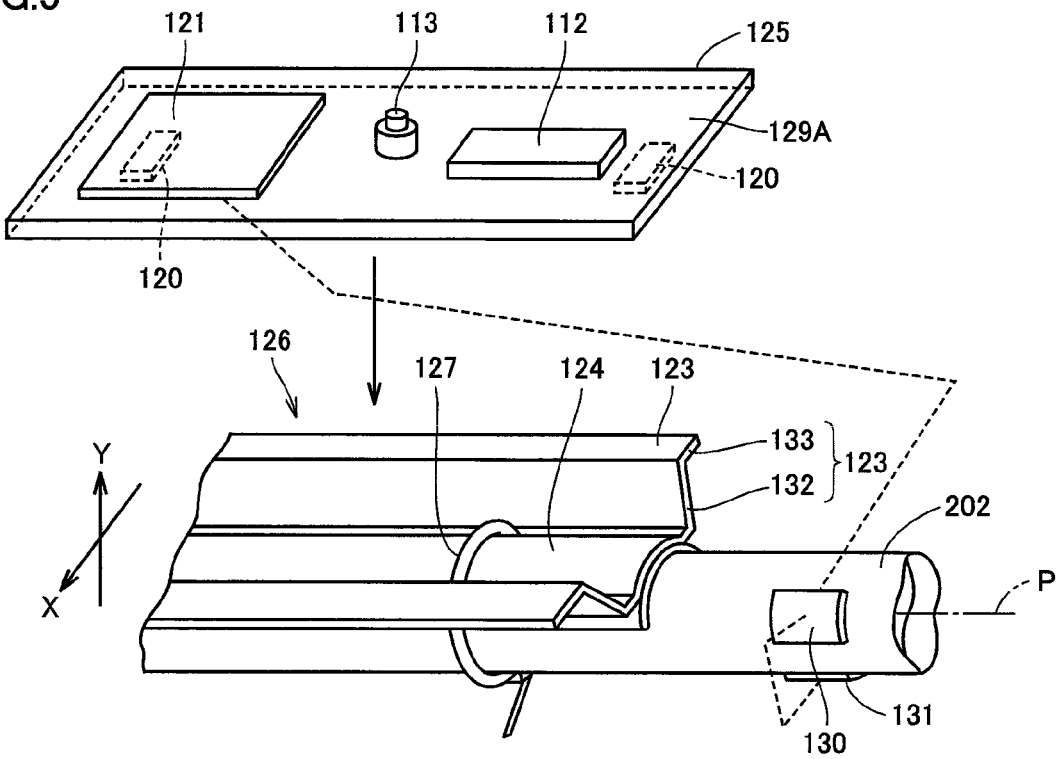
FIG. 5 is an exploded perspective view of the inside of measuring device.

FIG. 4 is a cross-sectional view of measuring device 100, and FIG. 5 is an exploded perspective view of the inside of measuring device 100. As shown in FIGS. 4 and 5, measuring device 100 is mounted on a surface of shaft 202. Measuring device 100 is provided on a circumferential surface of shaft 202, and it includes, by way of example, an elastically deformable buffer member 128 formed, for example, of polyester, a board holding portion 126 fixed on shaft 202 by a band 127 with buffer member 128 interposed, and a board 125 fixed by a bolt on an upper surface of board holding portion 126.

Board holding portion 126 includes a curved portion 124 curved along the shape of outer surface of shaft 202 to receive shaft 202 and buffer member 128, and flat portions 123 provided continuous to sides of curved portion 124. Board 125 is fixed on flat portions 123. Side portion of flat portion 123 is held between upper and lower casings 115 and 116, and upper and lower casings 115 and 116 are fixed to each other by a bolt.

Figure 6:
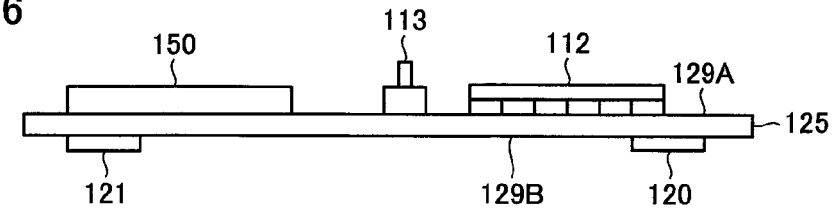
FIG. 6 is a side view of a board.

FIG. 6 is a side view of board 125. As shown in FIGS. 5 and 6, measuring device 100 includes acceleration sensors 120 and 121 attached to a main surface 129B of board 125 by means of solder or the like, a display unit 112 mounted on a main surface 129A of board 125, a processing unit 150 for performing various data processing, and a reset button 113. It is noted that acceleration sensors 120 and 121 are provided on main surface 129B that is opposite to the main surface 129A of board 125 on which processing unit 150, display unit 112 and reset button 113 are provided. Main surface 129B faces shaft 202, and acceleration sensors 120 and 121 are positioned closer to shaft 202 than processing unit 150 and display unit 112. Acceleration sensors 120 and 121 are arranged spaced apart by a distance in a direction P (longitudinal direction) of central axis of shaft 202. Display unit 112 is arranged between acceleration sensors 120 and 121.

Even if shaft 202 deforms as the golf player swings golf club 200, buffer member 128 elastically deforms and absorbs deflection of shaft 202. Therefore, even if shaft 202 deforms during a swing, deformation of board supporting portion 126 and board 125 can be reduced, and hence, positional deviation of acceleration sensors 120 and 121 can be reduced.

Thus, acceleration sensors 120 and 121 can accurately measure the acceleration of shaft 202 at respective positions of attachment. Acceleration sensors 120 and 121 are mounted on main surface 129B of board 125 such that acceleration of shaft 202 in the direction of central axis P of shaft 202 can be measured. As acceleration sensors 120 and 121, Surface Mount Micromachined Accelerometer (product name) manufactured by Freescale Semiconductor Japan Ltd. may be used.

Here, a method of detecting velocity of a geometrical central point R of a face of head 203 at the time of impact with a ball, using acceleration sensors 120 and 121 will be described. The geometrical central point R of the face is at a position spaced by a distance from acceleration sensors 120 and 121, in the direction of central axis P.

Referring to FIG. 1, it is assumed that, when a golf player swings golf club 200, golf club 200 is, at each moment, in a uniform circular motion about a virtual center of rotation O positioned on the central axis P.

The time of impact of ball and head 203 is detected, and assuming that even at the time of impact, golf club 200 is in uniform circular motion about virtual center of rotation O, virtual speed of central point R of head 203 is calculated from angular accelerations detected by acceleration sensors 120 and 121. On the other hand, correlation between virtual speed of central point R calculated assuming that golf club 200 makes a circular motion and velocity (swing speed) of head 203 actually measured by other measuring device during the swing is calculated in advance, and a correction function for making equal or approximating the virtual speed to the actually measured speed is calculated. With the swing of golf player during measurement, the calculated virtual speed is corrected by the correction function, whereby head speed approximated to the actual value is calculated.

Referring to FIG. 1, the method of calculating the virtual speed will specifically be described. In FIG. 1, acceleration sensors 120 and 121 are arranged in the direction of central axis P, and spaced apart from each other by a sensor-to-sensor distance r3, in the direction of central axis P. Acceleration sensor 120 is mounted at a position spaced by a center line distance r2 from virtual rotation center O in the direction of central axis P. Further, acceleration sensor 121 is mounted at a position spaced by a center line distance r1 from the virtual rotation center O. The central point R of the face of head 203 and acceleration sensor 120 are spaced by a center line distance L in the direction of central axis P.

Assume that a golf player swings golf club 200. Let us represent angular velocity of golf club 200 at the time of impact here by ω. Further, acceleration detected by acceleration sensor 120 is represented by α2, and acceleration detected by acceleration sensor 121 by α1. Then, Equations 1 and 2 below are satisfied. Further, virtual speed Vh at central point R can be given by Equation 3.

$$\alpha 1 = r1 \times \omega^2 \quad \text{Equation 1}$$

$$\alpha 2 = r2 \times \omega^2 = (r1 + r3) \times \omega^2 \quad \text{Equation 2}$$

$$Vh = (L + r2) \times \omega \quad \text{Equation 3}$$

By eliminating terms ω, r1 and r2 from Equations 1, 2 and 3, virtual speed Vh can be given by Equation 4 below.

$$Vh = (L + r3 + \alpha 1 \times r3/(\alpha 2 - \alpha 1)) \times ((\alpha 2 - \alpha 1)/r3)^{1/2} \quad \text{Equation 4}$$

Here, center line distance L and sensor-to-sensor distance r3 are determined by measuring device 100 and known values, and α1 and α2 can be measured by acceleration sensors 120 and 121, respectively.

Therefore, from the output values of acceleration sensors 120 and 121, virtual speed Vh can be calculated.

Figure 7:
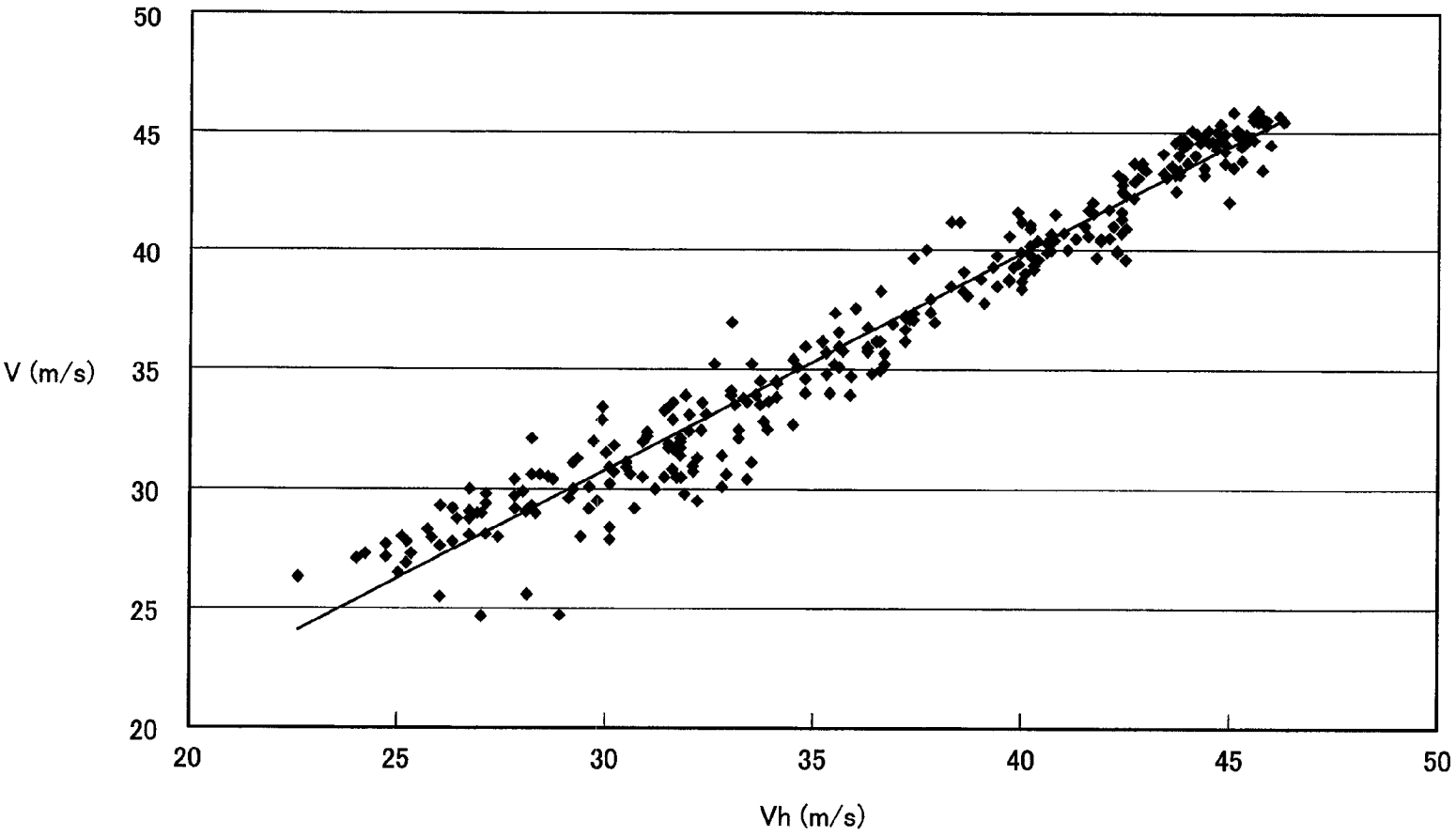
FIG. 7 is a graph showing correlation between virtual speed Vh and actual value.

FIG. 7 is a graph representing correlation between virtual speed Vh and the actually measured value. Referring to FIG. 7, a method of calculating a correction equation for approximating the virtual speed Vh to the actually measured value will be described. In the graph shown in FIG. 7, the abscissa represents actually measured velocity (swing speed) of central point R, while the ordinate represents virtual speed Vh calculated from Equation 4 based on output values from acceleration sensors 120 and 121.

As can be seen from FIG. 7, values (virtual speed Vh) calculated by inputting output values from acceleration sensors 120 and 121 during swings of golf club 200 to Equation 4 above, and actual values of the speed of central point R during the swings measured by a separate measuring device, are sampled. Then, as shown in FIG. 7, an approximate expression, as represented by Equation 5 below, is derived from the results. As to the measuring device for measuring the actual value, MAC-3D operation analysis system manufactured by Motion Analysis Corp., for example, may be used.

$$\text{Head speed } (V) = 0.9018 \times Vh + 3.7251 \quad \text{Equation 5}$$

The approximate expression represented by Equation 5 is only an example and not limiting. Further, the method of approximation is not limited to linear approximation and it may be a quadratic approximation of polynomial approximation, logarithmic approximation or exponential approximation.

When the actual head speed is to be measured using measuring device 100 storing correction data (approximate expression) as represented by Equation 5 above, virtual speed Vh is calculated by accelerations detected by acceleration sensors 120 and 121 and input to approximate expression of Equation 5, whereby accurate head speed V of central point R can be calculated.

Here, as shown in FIG. 7, by assuming that golf club 200 is in uniform circular motion in the process of a swing, high correlation can be found between the virtual speed Vh and the actually measured speed. Thus, highly accurate approximation of virtual speed Vh to the actual value becomes possible, and the accuracy of approximate expression as represented by Equation 5 can be improved. It is noted that the square value of R given by Equation 5 is about 0.957.

Naturally, by increasing the number of samples to be larger than in the example of FIG. 7, it becomes possible to calculate an approximate expression of higher approximation accuracy than Equation 5.

Figure 8:
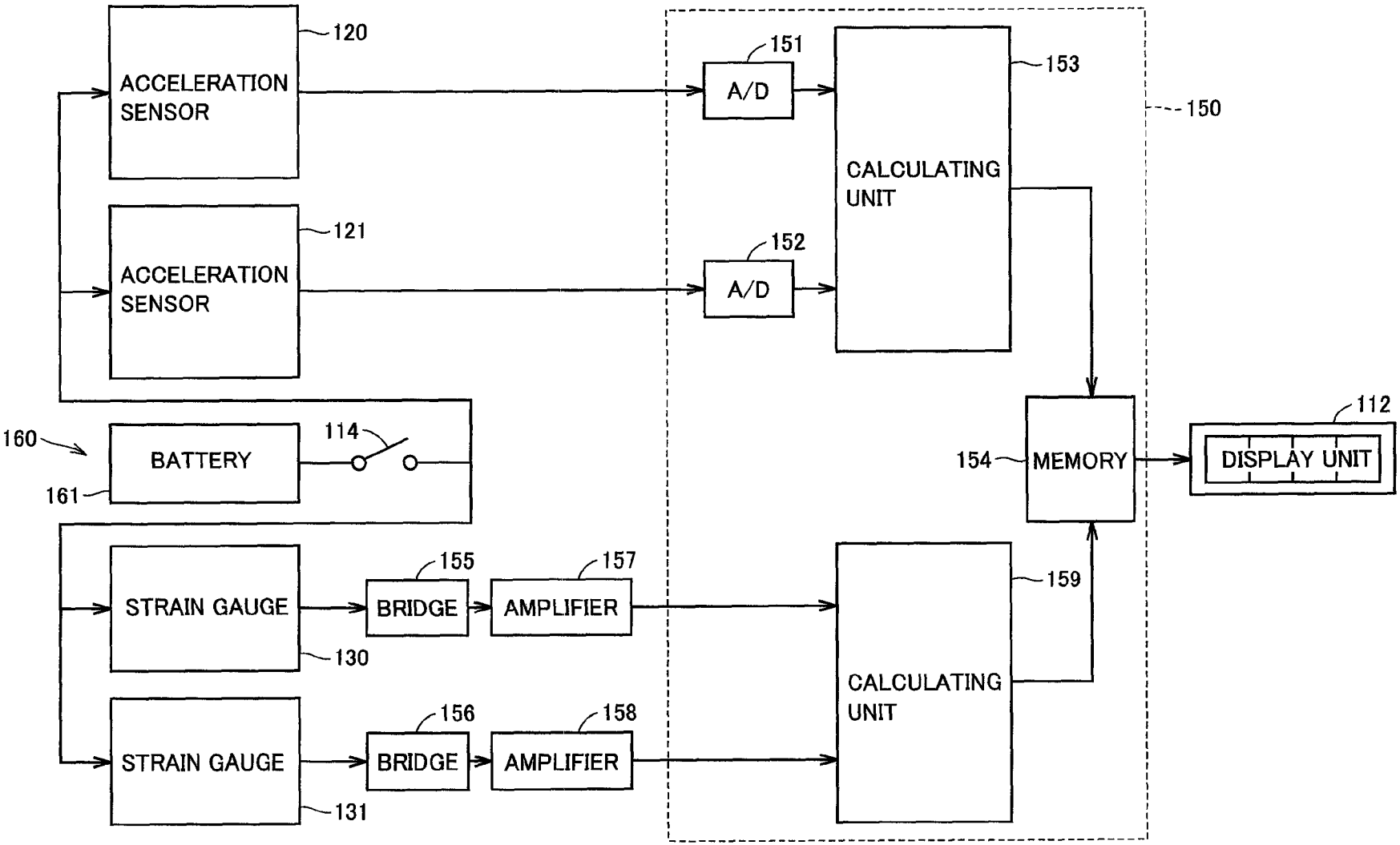
FIG. 8 is a schematic illustration showing a configuration of a processing unit.

FIG. 8 is a diagram schematically showing a configuration of processing unit 150. As shown in FIG. 8, processing unit 150 includes a converter 151 performing analog-digital conversion of an output voltage from acceleration sensor 120 and a converter 152 performing analog-digital conversion of an output voltage from acceleration sensor 121.

Processing unit 150 includes a calculating unit 153 for calculating accelerations of portions of shaft 202 on which acceleration sensors 120 and 121 are mounted, based on voltages output from converters 151 and 152, and a memory 154 for storing data output from calculating unit 153.

Measuring device 100 includes a power source unit 160, and a DC electric power of a prescribed voltage is supplied from power source unit 160 to acceleration sensors 120 and 121. Power source unit 160 includes a battery 161 and a power switch 114 that can be switched ON/OFF.

Figure 9:
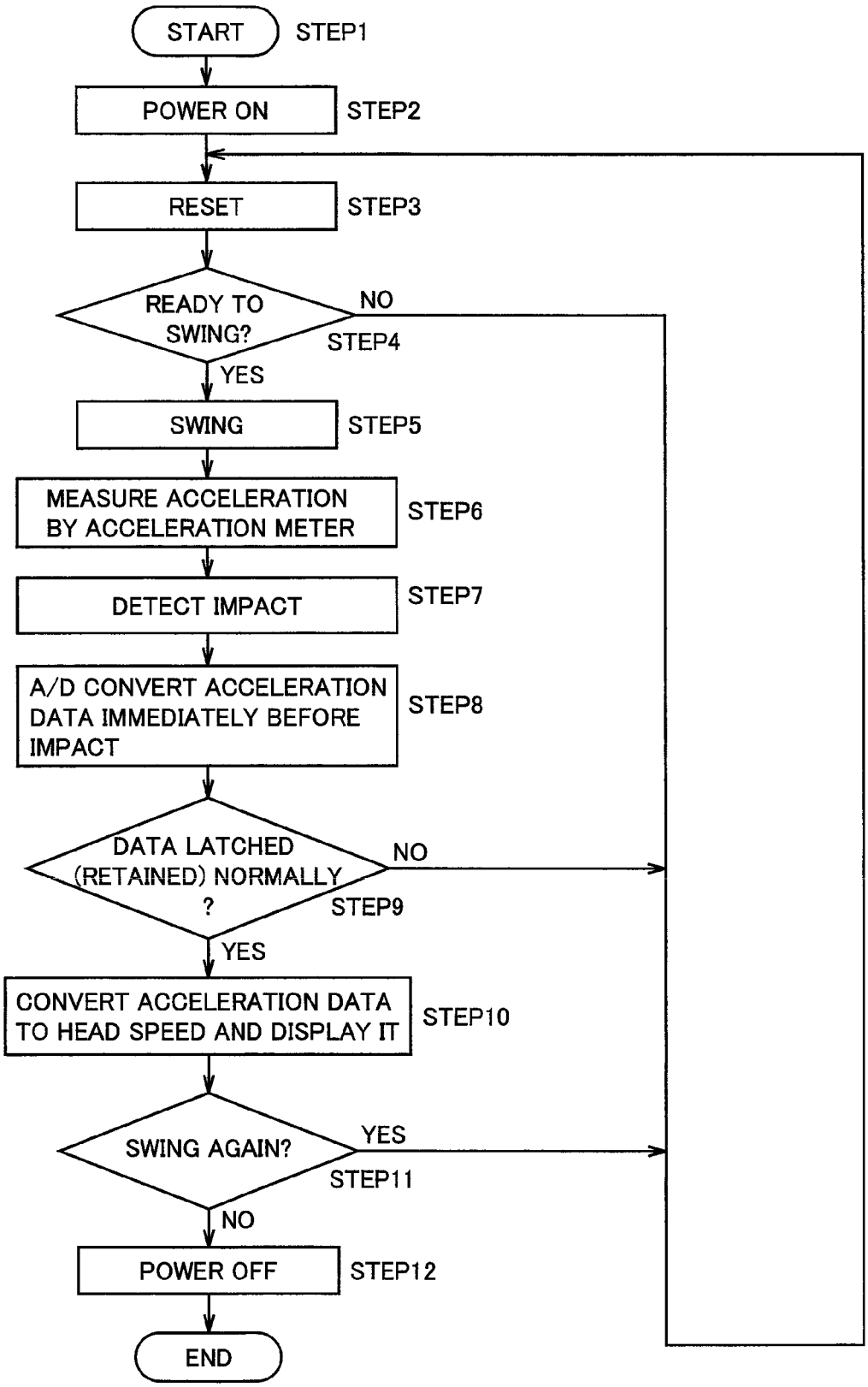
FIG. 9 is a flowchart of actually detecting head speed.

FIG. 9 is a flowchart when the head speed is actually detected. As shown in FIG. 9 and FIG. 8 above, when the head speed is to be detected, first, measuring device 100 is mounted on a prescribed position of golf club 200 and power switch 114 of measuring device 100 is turned ON (STEP 2). Further, reset button 113 is pressed, to return processing unit 150 and display unit 112 to the initial state (STEP 3). Thus, if the previous head speed should be displayed on display unit 112, measuring device 100 is set to a state ready to newly measure the head speed when reset button 113 is pressed (STEP 3).

Then, the golf player holds golf club 200 with the ball set in place, and the player is ready for the swing (STEP 4).

The golf player swings golf club 200 having measuring device 100 mounted thereon (STEP 5). With power switch turned ON, acceleration sensors 120 and 121 receive power from power supply unit 160, and provide outputs corresponding to accelerations at respective positions of mounting to calculating unit 153. Based on the voltages (signals) input from acceleration sensors 120 and 121, calculating unit 153 calculates accelerations at positions where acceleration sensors 120 and 121 are mounted (STEP 6).

Calculating unit 153 calculates accelerations at positions where acceleration sensors 120 and 121 are provided, based on the signals input from acceleration sensors 120 and 121.

Figure 10:
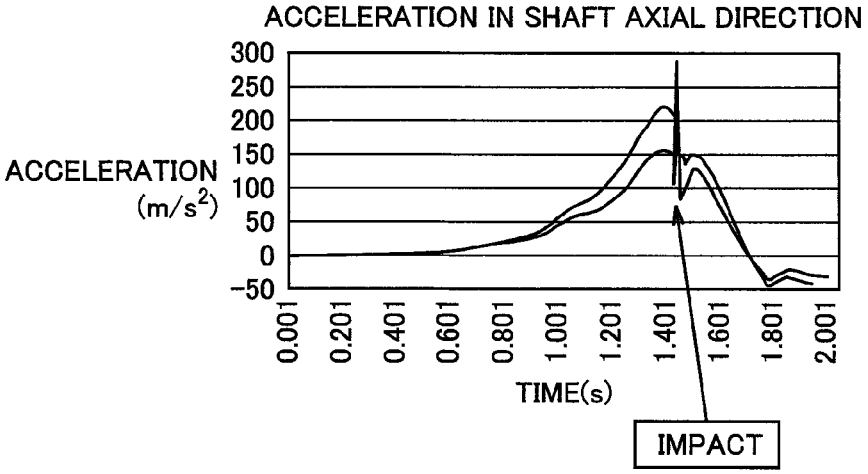
FIG. 10 is a graph representing acceleration calculated by a calculating unit, based on an output from the acceleration sensor.

FIG. 10 is a graph showing the acceleration calculated by calculating unit 153 based on the outputs from acceleration sensors 120 and 121, passed through a low pass filter.

Calculating unit 153 detects a time point at which accelerations calculated based on the outputs from acceleration sensors 120 and 121 both fluctuate by more than a prescribed amount within a prescribed time period, as an impact time point (STEP 7).

At the impact time point, head 203 hits the golf ball and acceleration of head 203 abruptly changes. Thus, based on the accelerations calculated from outputs of acceleration sensors 120 and 121 passed through a filter, the impact time point can be specified.

Figure 11:
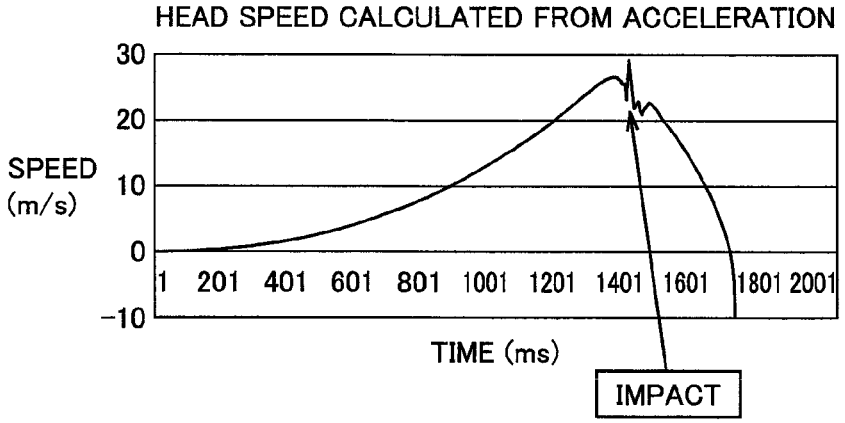
FIG. 11 is a graph showing head speed calculated based on an output from the acceleration sensor.
Figure 12:
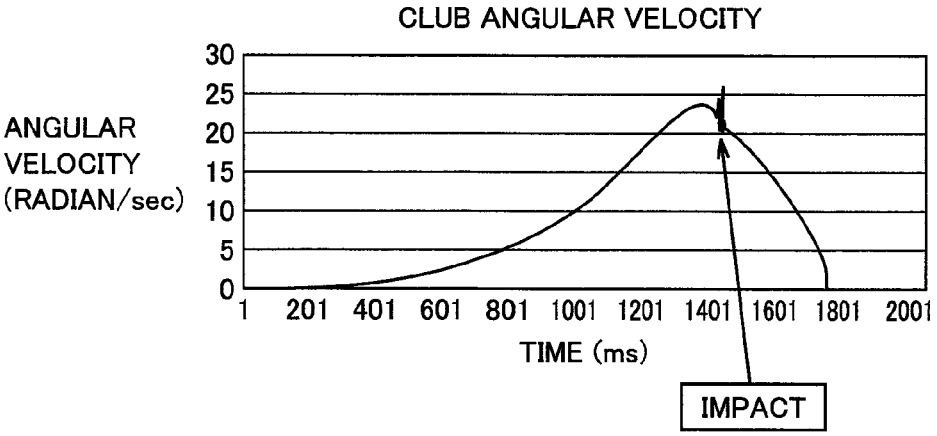
FIG. 12 is a graph representing angular velocity ω of a golf club during a swing.

Then, calculating unit 153 performs A/D (analog-to-digital) conversion of the acceleration data immediately preceding the impact (STEP 8). Then, it confirms whether the converted data has been normally latched (retained) in memory 154 (STEP 9). Based on the latched acceleration data, calculating unit 153 calculates virtual speed Vh. Then, based on the virtual speed Vh, it calculates head speed V. The calculated head speed V is displayed on display unit 112 (STEP 10). A liquid crystal display unit or the like capable of displaying four digits, for example, is used as display unit 112. FIG. 11 is a graph representing the head speed calculated based on the outputs from acceleration sensors 120 and 121, showing the head speed during a swing. When the head speed is calculated, angular velocity ω of golf club 200 can also be calculated. FIG. 12 is a graph representing angular velocity ω of golf club 200 during a swing.

As shown in FIG. 9, for the next swing, reset button 113 is pressed, and measuring device 100 is again set to a state capable of newly calculating the head speed (STEPS 10, 11). When head speed calculation is to be finished, power switch 114 is turned OFF (STEP 12). Thus, head speed calculation ends.

As described above, according to the measuring device 100 of the present embodiment, the head speed at the impact time point can be detected with high accuracy, and based on the accurate swing speed, the golf player's swing can be analyzed.

Further, measuring device 100 can be mounted on golf club 200 and, therefore, the head speed can be output without using any device other than the measuring device 100. Thus, the head speed can be measured easily regardless of the place of measurement.

Here, measuring device 100 includes strain gauges 130 and 131 mounted on a surface of shaft 202, as shown in FIG. 5.

Strain gauge 130 is adhered on a side aligned with the ball flying direction (X-axis direction) while strain gauge 131 is adhered on a side aligned with the direction (Y-axis direction) orthogonal to the ball flying direction, on the circumferential surface of shaft 202. Preferably, strain gauges 130 and 131 are mounted at a position of about 12 inches (about 304 mm) to about 15 inches (about 381 mm) from the grip-side end.

Referring to FIG. 8, output voltages from strain gauges 130 and 131 are input to amplifiers 157 and 158 through bridges 155 and 156, and thereafter, output to a calculating unit 159. Calculating unit 159 calculates amounts of strain at portions of shaft 202 on which strain gauges 130 and 131 are mounted. From the amounts of strain, combined amount of strain is calculated. Then, the amount of deflection of shaft 202 is calculated from the combined amount of strain.

The amount of deflection maximizes near the top of swing. The "maximum amount of deflection" serves as an index of "swing tempo." Generally, preferable "maximum amount of deflection" during a swing is about 70 to 130 mm (and more preferable amount is about 100 mm). The "maximum amount of deflection" is the maximum amount of displacement at the tip end portion with respect to the gripping portion of the shaft. Here, a portion of common length generally gripped by the player (about 7 inches, about 180 mm) from the grip side end is regarded as gripping portion, and the maximum amount of displacement of the gripping portion with respect to the tip end portion is calculated.

Calculating unit 159 outputs the calculated maximum amount of deflection to memory 154, and memory 154 stores the input maximum amount of deflection. The maximum amount of deflection stored in memory 154 is displayed on display unit 112, by an operation of a display switching unit, not shown. Based on the maximum amount of deflection, the swing tempo can be determined and swing analysis becomes possible.

Measuring device 100 is capable of detecting acceleration $\alpha 2$ based on the output from acceleration sensor 120 and detecting acceleration $\alpha 1$ based on the output from acceleration sensor 121.

Figure 13:
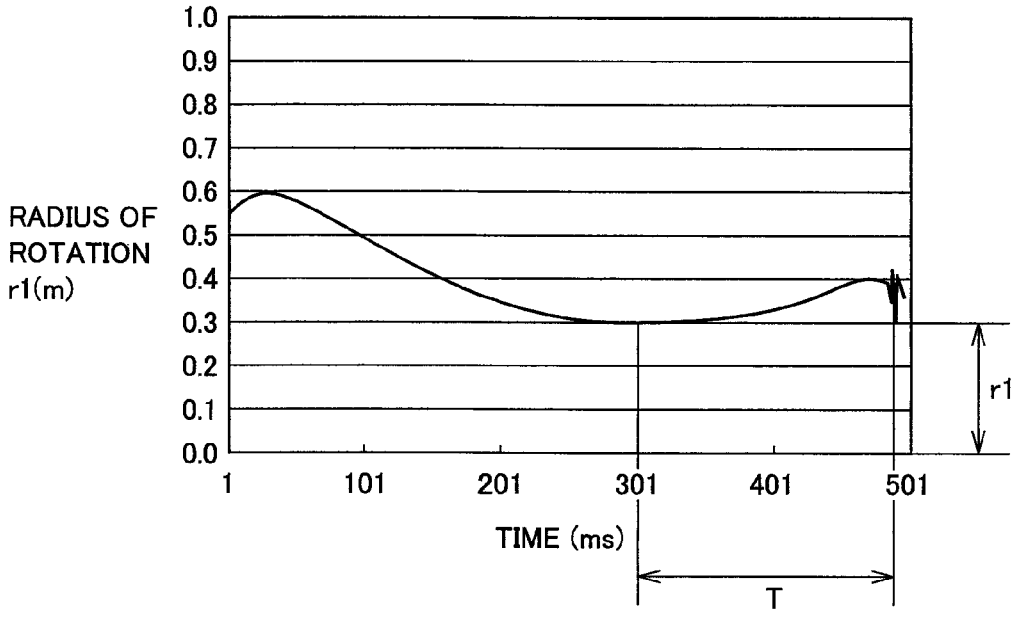
FIG. 13 is a graph showing fluctuation of center distance in the process of a swing by a golf player A.

Therefore, radius of rotation r1 can be calculated from Equations 1 and 2 above. FIG. 13 is a graph representing fluctuation of radius of rotation r1 in the process of a swing by a golf player A, while FIG. 14 is a graph representing fluctuation of radius of rotation r1 in the process of a swing by a golf player B.

Figure 14:
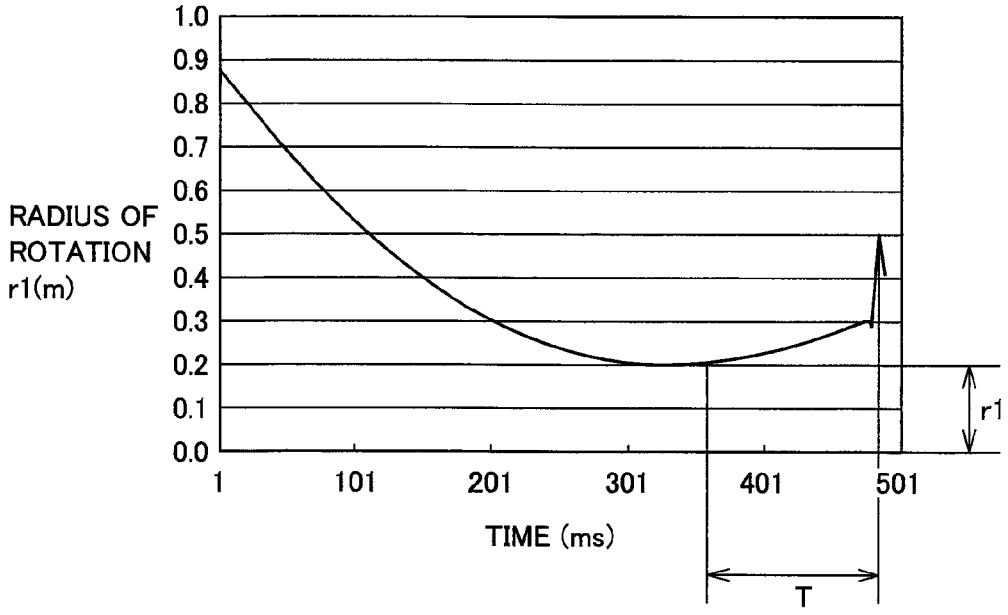
FIG. 14 is a graph showing fluctuation of center distance in the process of a swing by a golf player B.

Referring to FIGS. 13 and 14, focusing on the fact that minimum radius of rotation r1 differs player by player, the swing type of a golf player may be analyzed, for example, from the minimum radius of rotation r1, or time T until the impact time point from minimum radius of rotation r1. It is particularly effective to analyze the use of cock. In FIGS. 13 and 14, the abscissa represents measurement time (ms), and the ordinate represents radius of rotation (m). FIG. 13 shows time-change of radius of rotation of golf player A, where ratio of translational velocity to angular velocity is large. FIG. 14 shows time-change of radius of rotation of golf player B, where ratio of translational velocity to angular velocity is small.

An example in which measuring device 100 is applied to a system for selecting a golf club shaft will be described.

Figure 15:
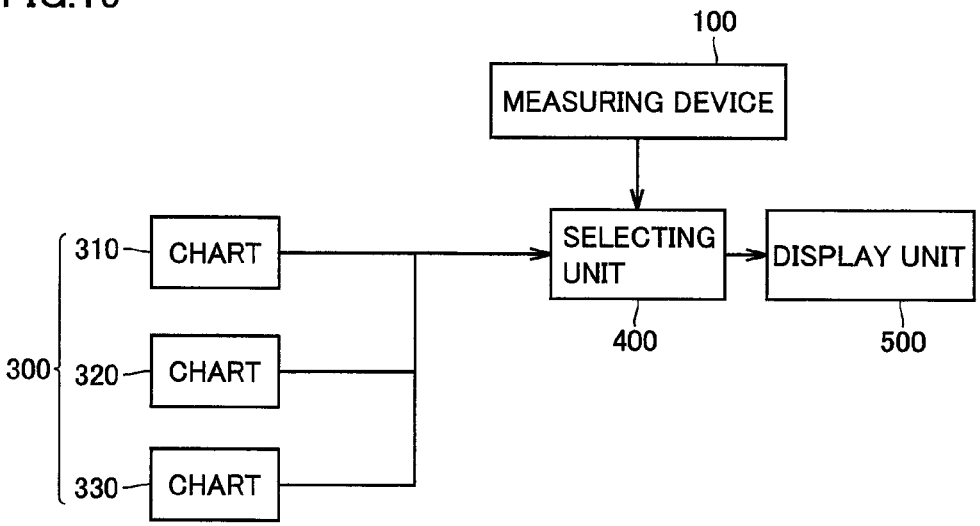
FIG. 15 is a block diagram showing a configuration of a golf club shaft selecting system in accordance with an embodiment of the present invention.

FIG. 15 is a block diagram showing the golf club shaft selecting system in accordance with an embodiment of the present invention. Referring to FIG. 15, the golf club shaft selecting system of the present embodiment includes measuring device 100 that detects head speed at the impact time point during a swing of a golfer and detects swing tempo of the golfer.

The golf club shaft selecting system mentioned above further includes a chart 300 representing shaft mass and kick point corresponding to the swing characteristic of each golfer, a selecting unit 400 for selecting a golf club shaft suitable for the golfer based on the head speed and swing tempo detected by measuring device 100 with reference to chart 300, and a display device 500 displaying a golf club shaft selected by the selecting unit 400. Here, chart 300 includes a first chart 310 indicating preferable shaft mass in accordance with the head speed and swing tempo of each golfer, a second chart 320 indicating preferable kick point in accordance with the head speed and swing tempo of each golfer, and a third chart 330 (other chart) indicating preferable flex in accordance with the head speed and swing tempo of each golfer.

Chart 300 is stored, for example, in a hard disk of a computer. As the selecting unit 400, by way of example, a computer having a CPU is used. The display unit 500 connected to selecting unit 400 may be a display or a printer.

To selecting unit 400, information from measuring device 100 is input. Selecting unit 400 classifies swing characteristics of respective golfers based on the result of analysis by measuring device 100 while making a reference to chart 300, and based on the result of classification, selects a golf club shaft having the suitable shaft mass and kick point for each golfer. The result of selection is displayed on display device 500.

Chart 300 may be a panel representing the relation between head speed/swing tempo and preferable shaft mass/kick point. Further, a "person," rather than selecting unit 400, may select the preferable shaft.

In the golf club selecting system, the swing tempo of a golfer is detected by measuring device 100 based on the maximum amount of deflection of the shaft during a swing. It is also possible to correctly detect the "swing tempo" necessary for selecting a golf club shaft based on any of the swing time, the club heads speed (swing speed) prescribed time before the top of swing, and on the club head acceleration (swing acceleration) near the top of swing. Therefore, a device for detecting such parameters may be provided.

Figure 16:
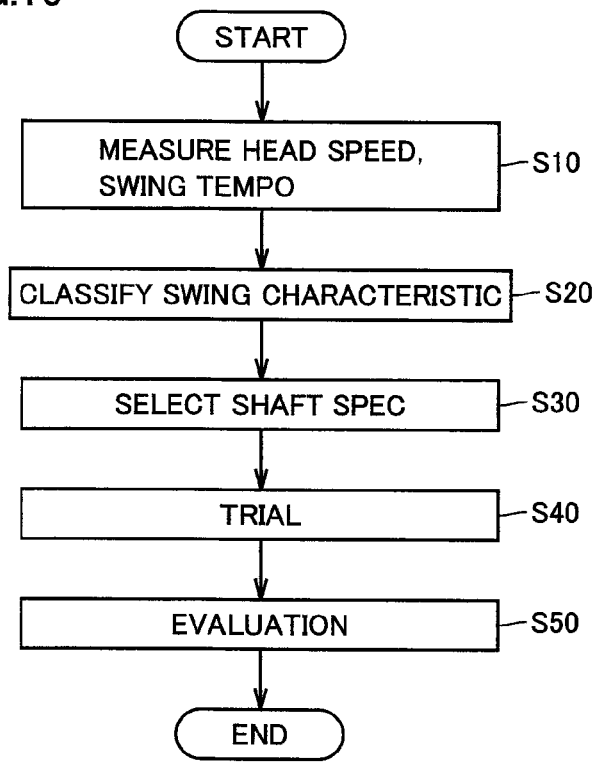
FIG. 16 is a flowchart representing the method of selecting a golf club shaft in accordance with an embodiment of the present invention.

FIG. 16 is a flowchart representing a method of selecting a golf club shaft in accordance with an embodiment of the present invention. Referring to FIG. 16, at step S10, the head speed and the swing tempo at the impact time point of a swing are measured by measuring device 100.

Next, at S20, based on the result of measurement by measuring device 100, swing characteristic of the user is classified. Specifically, determination is made as to which of a plurality of groups prepared in advance the golfer's head speed and swing tempo belong.

At S30, based on the result of classification, a club shaft suitable for the swing characteristic (head speed and swing tempo) of the golfer is selected. At this time, reference is made to the first chart 310 indicating preferable shaft mass in accordance with the head speed and swing tempo at the impact time point, the second chart 320 indicating preferable kick point in accordance with the head speed and swing tempo at the impact time point, and the third chart 330 indicating preferable flex in accordance with the head speed and swing tempo at the impact time point. The golf club shaft selected at S30 may be one shaft, or a plurality of shafts (for example, two or three shafts).

The classification step S20 may be omitted. Specifically, the selecting step S30 may be performed based on the result of measurement at S110.

Next, at S40, using a golf club with the selected club shaft, a trial is done. At S50, the tried golf club is evaluated. Here, objective data such as "head speed," "ball speed," "meet," "ball spin amount," "launch angle," "variation in hitting points" and "variation in trajectory" as well as feelings of the golfer such as "easy/hard to attain good timing," "easy/hard to swing" may be used as evaluation standards.

Exemplary method of evaluation at S50 will be described.

The "variation in hitting points" may be detected, for example, by attaching a so-called "face seal" on the face of the club head for trial, as the color of the seal changes where ball contacts at the time of hitting.

When "meet" is used for evaluation, the following method is used.

"Meet" (=ball initial speed/head speed) is a larger-the-better characteristic, that is, the higher the better. When we represent meet of i-th trial by yi, SN ratio (η) of meet yi (i=1 to n) is calculated in accordance with Equations 6 and 7 below.

$$\eta = 1/Ve \qquad \text{Equation 6}$$

$$Ve = (1/n)\sum_{i=1}^{n}(1/y_i)^2 \qquad \text{Equation 7}$$

Examples of meet and SN ratio thereof resulting from three trials of club shafts having mass of 50 g, 60 g and 70 g, respectively, are as shown in Table 1.

TABLE 1

| Mass (g) | Head Speed (m/s) | Ball Speed (m/s) | Meet | SN Ratio |
|---|---|---|---|---|
| 50 | 41.6 | 58.8 | 1.41 | 1.88 |
| | 42.0 | 56.9 | 1.35 | |
| | 41.3 | 55.9 | 1.35 | |
| 60 | 41.9 | 58.7 | 1.40 | 1.91 |
| | 41.0 | 56.8 | 1.39 | |
| | 41.5 | 56.4 | 1.36 | |
| 70 | 41.2 | 58.1 | 1.41 | 1.82 |
| | 40.9 | 54.2 | 1.33 | |
| | 40.7 | 53.7 | 1.32 | |

In the examples shown in FIG. 1, the highest SN ratio is attained when the shaft having the mass of 60 g is used. Therefore, the club shaft having the mass of 60 g is determined to be the best.

The contents described above will be summarized. The golf club shaft selecting method in accordance with the present embodiment includes: the step (S10) of detecting head speed and swing tempo of a golfer during a swing; the step (20) of classifying the golfer's swing based on the result of detection of the detecting step; and the step of selecting a golf club shaft having the shaft mass and kick point suitable for the golfer, based on the result of classification at the classification step.

The inventors confirmed that there is a certain relation between the swing type of a golfer (swing tempo and head speed at the impact time point) and the shaft mass and kick point suitable for the golfer. Therefore, by the method of selecting golf club shaft, objective standard for selection can be obtained, in relation to the shaft mass and kick point. Therefore, a golf club more suitable for each golfer can be selected.

Further, the inventors have confirmed that, in selecting the kick point in accordance with the swing characteristic of each golfer, a relation between the bending stiffness of club shaft at the central portion in the longitudinal direction (central part of shaft) and the bending stiffness of club shaft at the gripping portion and the tip end is closely related. Therefore, if the kick points of shafts as the object of selection are classified in accordance with the relation between bending stiffness of club shaft at the central portion, bending stiffness of club shaft at the tip end portion and the bending stiffness of the club shaft at the gripping portion, more suitable kick point for each golfer can be selected.

Though an example in which chart 300 includes the first chart 310 indicating preferable shaft mass in accordance with the head speed and swing tempo at the impact time point, the second chart 320 indicating preferable kick point in accordance with the head speed and swing tempo at the impact time point, and the third chart 330 indicating preferable flex in accordance with the head speed and swing tempo at the impact time point has been mainly described in the present embodiment, chart 300 may include only the first and second charts 310 and 320, or it may include only the first chart 310, or only the second chart 320.

If chart 300 includes first to third charts 310, 320 and 330, it is possible to support selection of a club shaft having the shaft mass, kick point and flex suitable for each golfer. If the chart 300 has only the first and second charts 310 and 320, it is possible to support selection of a club shaft having the shaft mass and kick point suitable for each golfer. If the chart 300 has only the first chart 310, it is possible to support selection of a club shaft having the shaft mass suitable for each golfer. If the chart 300 has only the second chart 320, it is possible to support selection of a club shaft having the kick point suitable for each golfer.

As to the plurality of clubs used for trial at S40 described above, it is preferred to use clubs having the same club head, same head mass, same length and same grip. Thus, when the club shaft suitable for each golfer is selected, a golf club suitable for each golfer can be selected.

[Embodiment 1]

Figure 17:
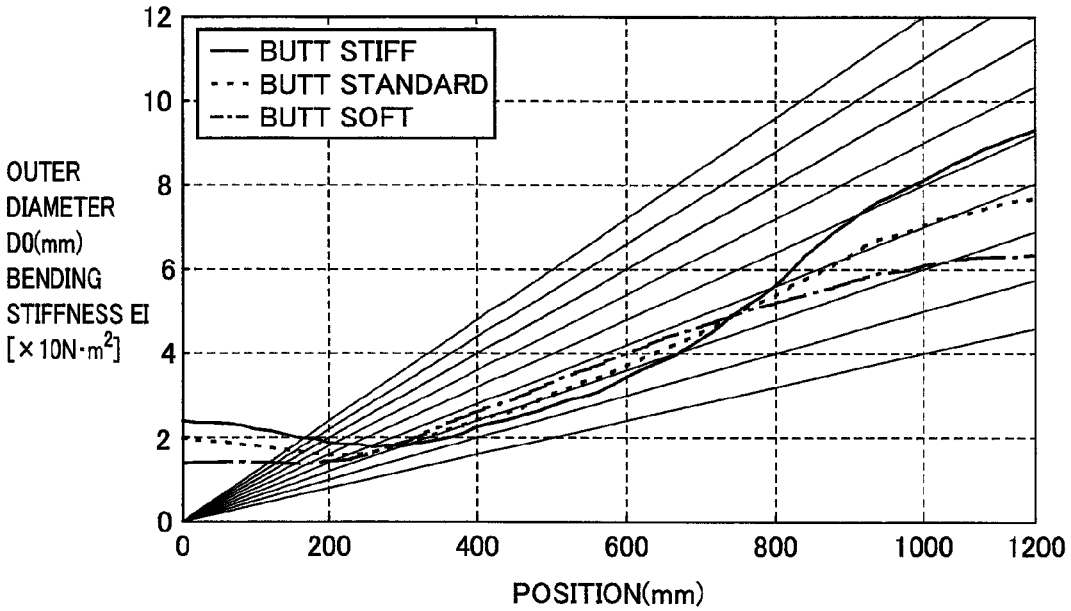
FIG. 17 shows outer diameter of the golf club shaft and bending stiffness distribution used for the method of selecting golf club shaft in accordance with an embodiment of the present invention.

FIG. 17 shows outer diameter and bending stiffness distribution (El distribution) of golf club shafts used in the method of selecting golf club shaft in accordance with an embodiment of the present invention. In FIG. 17, the abscissa represents a distance from the club-head side end of golf club shaft. In the example shown in FIG. 17, the outer diameter and bending stiffness of a golf club shaft increase from the club head side to the grip side.

FIG. 17 shows data of three club shafts (butt standard/butt stiff/butt soft) having the same amount of deflection in cantilever model, while having mutually different EI distributions. Details of the "cantilever model" and "butt standard/butt stiff/butt soft" will be described later.

In the following, the method of measuring bending stiffness distribution of golf club shaft will be described.

The bending stiffness is calculated by the following equation, based on the inclination of displacement-load, in three-point bending test.

$$EI=(W/\delta)\times LI^3/48$$

EI: bending stiffness, W: load, δ: amount of deflection at the load point (displacement), L1: span (distance between support points).

Conditions of three-point bending test conducted by the inventors are as follows.

Support points of R10 mm (radius of 10 mm) were set with the distance between support points: span L1 set to 20 mm. As the load point, an indenter jig (formed of iron) of R 75 mm (radius of 75 mm) was used, and it was set to exert load at the central point between the support points. The test speed was 2 mm/min, and as W/δ, data of variation in deflection amount (displacement) were extracted with the load variation of 10 kgf (98N) to 20 kgf (196N). Thus, bending stiffness at the load point can be obtained. By repeating measurements while moving the load point, bending stiffness distribution can be obtained.

Measurement of bending stiffness by four-point bending test is effective when the sample thickness is thin for its outer diameter (particularly effective for gripping portion). The bending stiffness in the four-point bending test is calculated by the following equation.

$$EI=(W/\delta)\times(a/48)\times(3L1^2-4a^2)$$

EI: bending stiffness, W: load (there are two points of load, and each load is W/2), L1: span (distance between support points), δ: amount of deflection (displacement) at the central point of span (central point between support points), a: distance from support point on one side to neighboring load point, (L1−a)/2: distance between two load points.

Conditions of four-point bending test conducted by the inventors are as follows.

Support points of R75 mm (radius of 75 mm) and indenter jig (formed of iron) of R 75 mm (radius of 75 mm) were used, and the distance between support points: span L1 was set to 300 mm. The distance between the two load points was set to 130 mm. Specifically, the distance a from support point on one side to neighboring load point was set to 85 mm. The test speed was 2 mm/min, and as W/δ, data of variation in deflection amount (displacement) were extracted with the load variation of 15 kgf (147N) to 20 kgf (196N). Thus, bending stiffness at the central point between two load points can be obtained. By repeating measurements while moving the load point, bending stiffness distribution can be obtained.

There is also a method of calculating bending stiffness EI by attaching a one-directional strain gauge in the longitudinal direction of a golf club shaft at a position where the bending stiffness is to be measured, fixing the grip portion of the shaft and measuring variation in strain ϵ when the load is applied to the head side of the shaft. In that case, bending stiffness is calculated by the following equation.

$$EI=(W\times L2)\times(d/2)/\epsilon$$

EI: bending stiffness, W: load, L2 distance from the position of measuring strain to the load point, d: outer diameter of the position of measuring strain, ϵ: amount of strain.

Conditions of the test using strain gauge, conducted by the inventors are as follows.

First, the strain gauge was attached to the position where the bending stiffness was to be measured. Next, 50 mm on the grip side of the shaft was fixed using a cylinder chuck (three-claw chuck), with the strain gauge facing upward. The load point was set at a position of L2:700 mm from the position of strain gauge to the side of shaft head. As to the method of applying load, a weight of W: 1 kgf (9.8N) was suspended. The values output from the strain gauge before and after suspending the weight were used as the amount of strain $\epsilon$. The outer diameter d of the position for measuring strain was measured separately.

Figure 18:
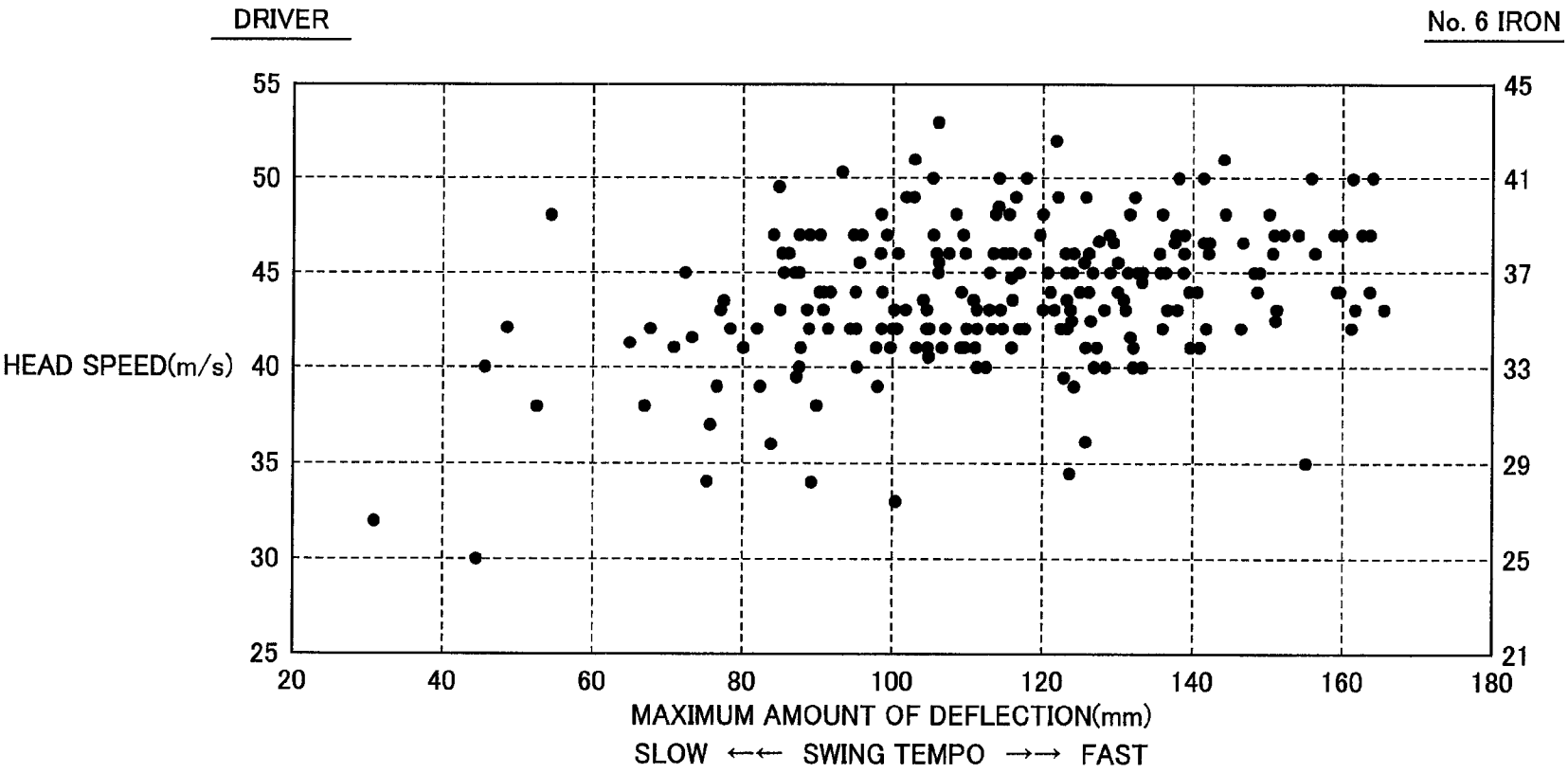
FIG. 18 shows distribution of swing tempo and head speed detected at the detecting step in the method of selecting golf club shaft in accordance with an embodiment of the present invention.

FIG. 18 shows distribution of head speed and swing tempo (maximum amount of deflection of club shaft during a swing) detected at the detection step of the method of selecting golf club shaft in accordance with the present embodiment. In the present embodiment, measurement was made using golf clubs (driver and number-six iron) having the diameter and bending stiffness distribution shown in FIG. 17. FIG. 18 shows results of measurement of swings by more than 300 golfers.

As shown in FIG. 18, correlation is not always found between the swing tempo and the head speed (at the impact time point). Therefore, in classifying swing characteristics of each golfer, both the swing tempo and the head speed must be considered.

Figure 19:
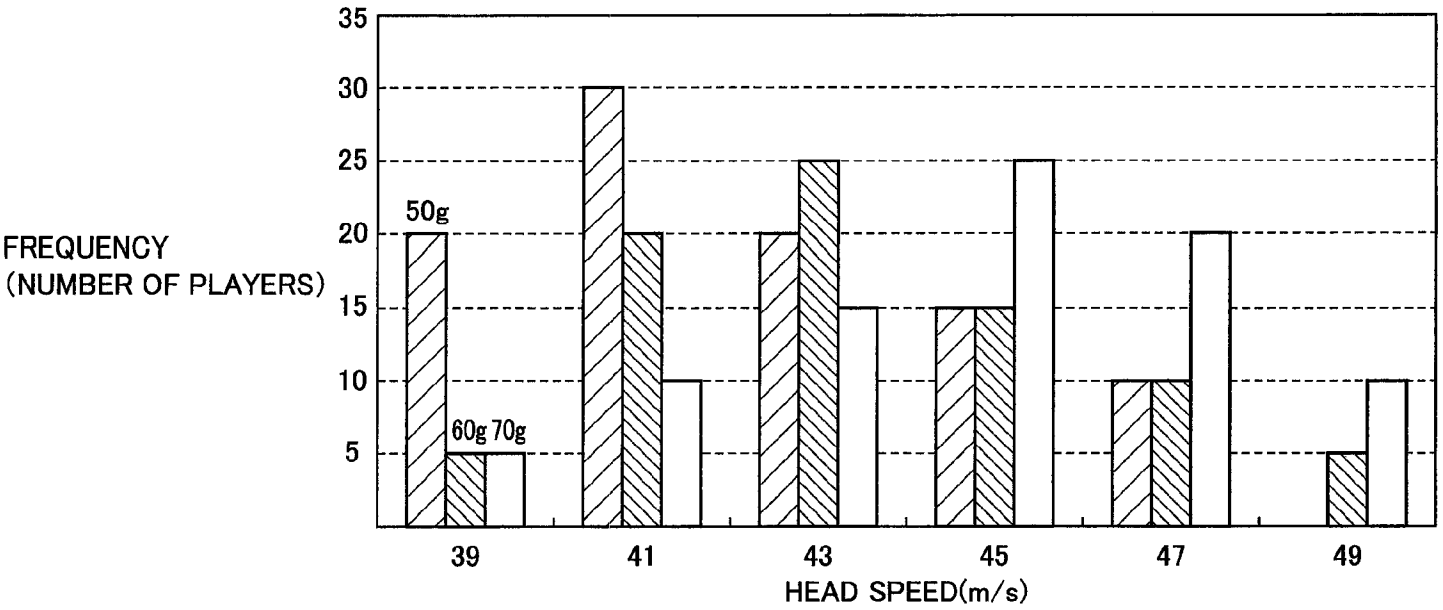
FIG. 19 plots relation between head speed and frequency of high SN ratio of meet, for different shaft mass.

FIG. 19 shows the relation between the head speed and the frequency of high meet SN ratio of different shaft masses. The results shown in FIG. 19 represent data with the population of about 90 ordinary golfers. Referring to FIG. 19, when the shaft mass was 50 g, frequency of high SN ratio attains local maximum when head speed was 41 (m/s). When the shaft mass was 60 g, frequency of high SN ratio attains local maximum when head speed was 43 (m/s), and when the shaft mass was 70 g, frequency of high SN ratio attains local maximum when head speed was 45 (m/s). In other words, for a golfer whose head speed is about 41 (m/s), a club shaft having the mass of about 50 g is suitable, for a golfer whose head speed is about 43 (m/s), a club shaft having the mass of about 60 g is suitable, and for a golfer whose head speed is about 45 (m/s), a club shaft having the mass of about 70 g is suitable. There is a tendency that a club shaft of larger mass is suitable for a golfer whose head speed is higher.

Figure 20:
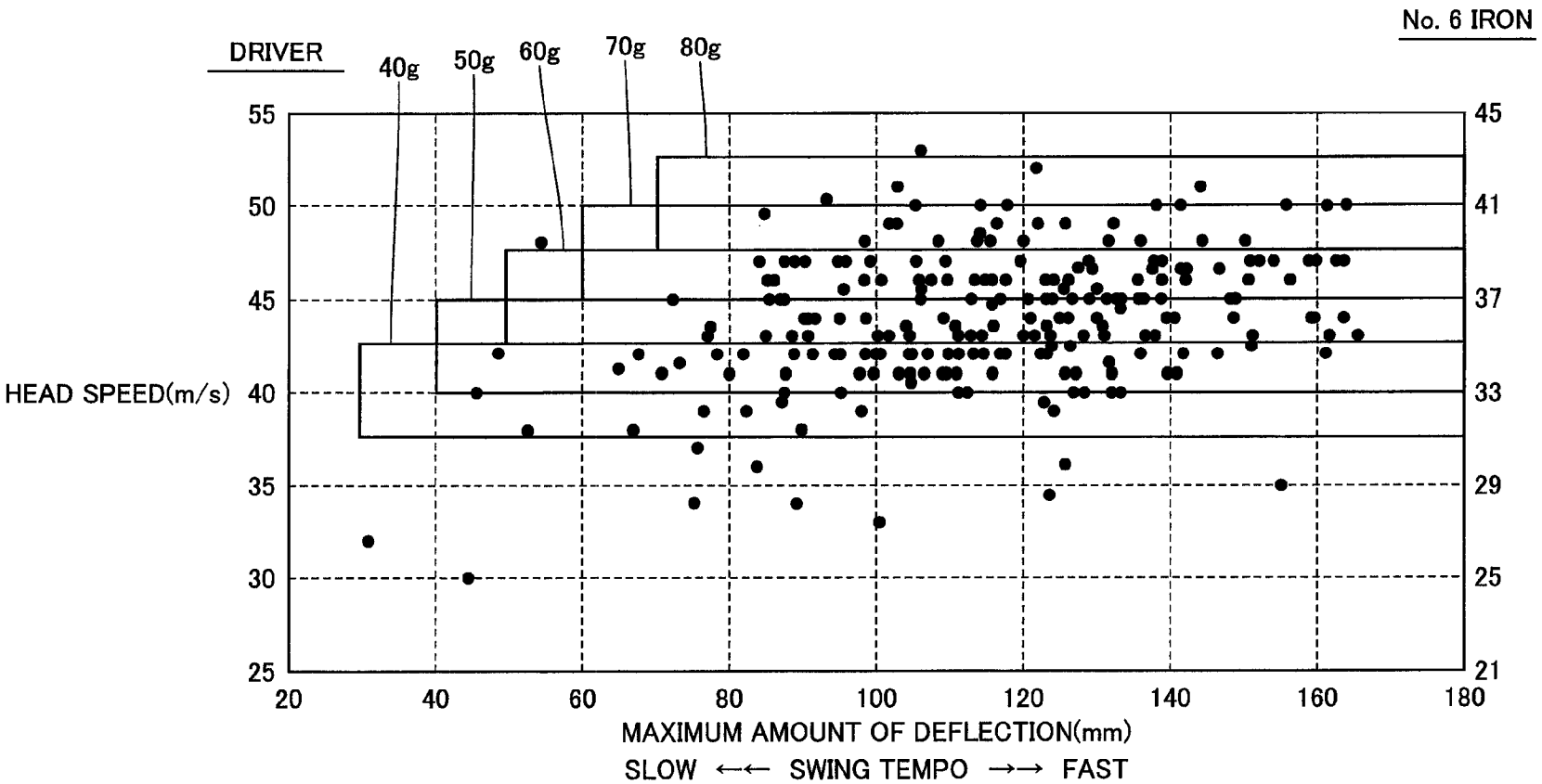
FIG. 20 is a diagram (first chart) representing relation between swing characteristic and preferable shaft mass.

FIG. 20 is a diagram (first chart) representing the relation between swing characteristic and preferable shaft mass, derived from the result shown in FIG. 19. Referring to FIG. 20, the head speed of each golfer and the shaft mass suitable for the golfer are not in perfect one-to-one correspondence. Therefore, in FIG. 20, there are areas suitable for different shaft masses (for example, 40 g and 50 g) overlapped with each other. In the present embodiment, club shafts having the mass of 40 g, 50 g, 60 g, 70 g and 80 g were prepared as shown in FIG. 12, to cover about 90% of the golfers.

Figure 21:
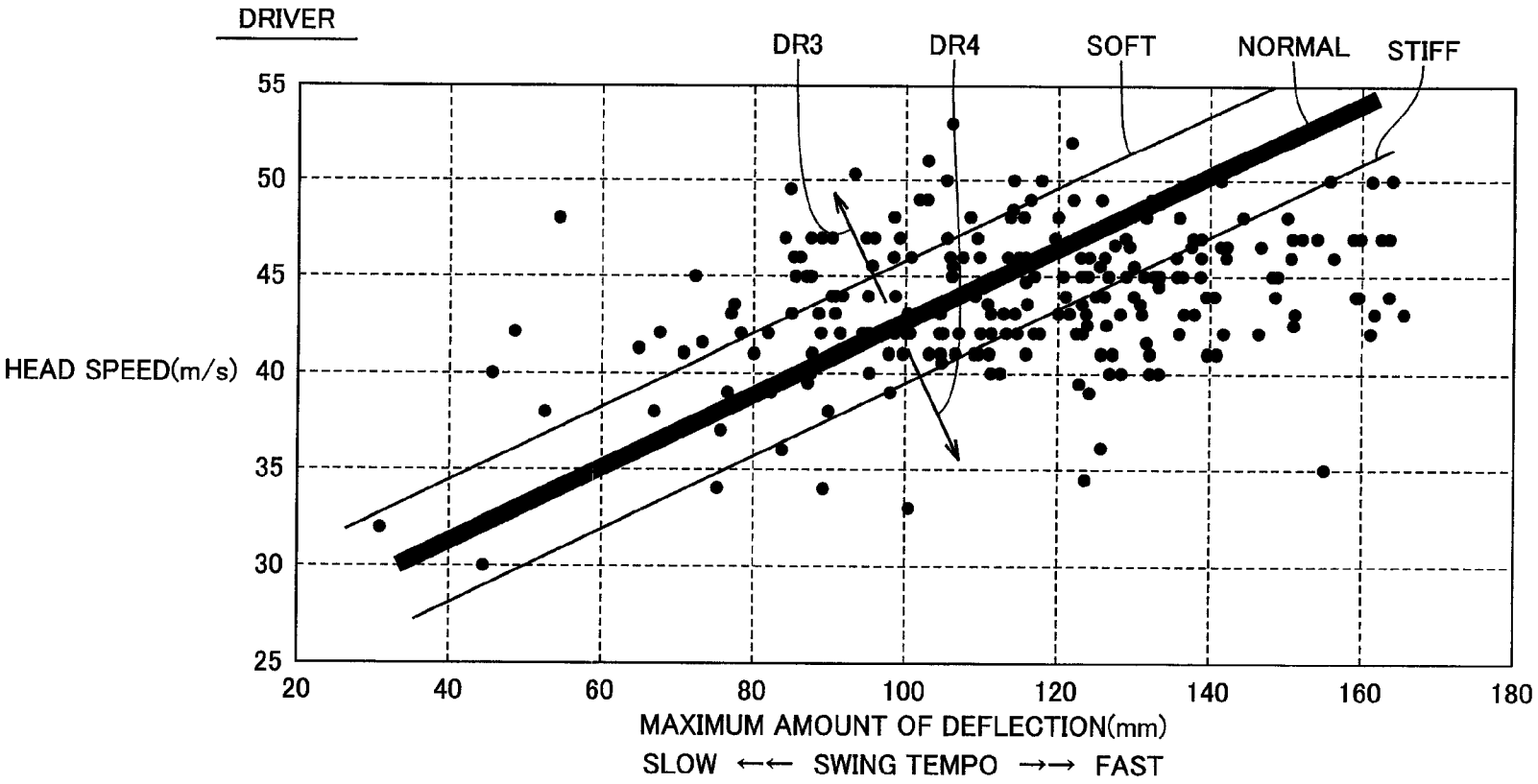
FIG. 21 is a diagram (second chart) representing relation between swing characteristic and preferable kick point.

FIG. 21 is a diagram (second chart) representing the relation between swing characteristic and preferable kick point. In FIG. 21, "NORMAL" line represents a line on which the relation between the head speed and the swing tempo is at an average level, among good golfers (for example, professional golfers or single handicap golfers). Here, the "NORMAL" line is derived by least square method, from the data of head speed and swing tempo of the good golfers. Referring to FIG. 21, as the swing characteristic goes away from the NORMAL line (in the direction of arrows DR3 and DR4), the bending stiffness distribution of the shaft must be set away from the standard. In FIG. 21, for golfers distributed between the STIFF line and the SOFT line (that is, golfers attaining good balance between the head speed and swing tempo), club shafts of the type having standard bending stiffness distribution (hereinafter referred to as "butt standard") are suitable. For golfers distributed lower right than the STIFF line (that is, golfers whose swing tempo is faster for the head speed), club shafts of the type having relatively hard gripping portion (hereinafter referred to as the "butt stiff") are suitable. For golfers distributed upper left than the SOFT line (that is, golfers whose swing tempo is slow for the head speed), club shafts of the type having relatively soft gripping portion (hereinafter referred to as "butt soft") are suitable.

Figure 22:
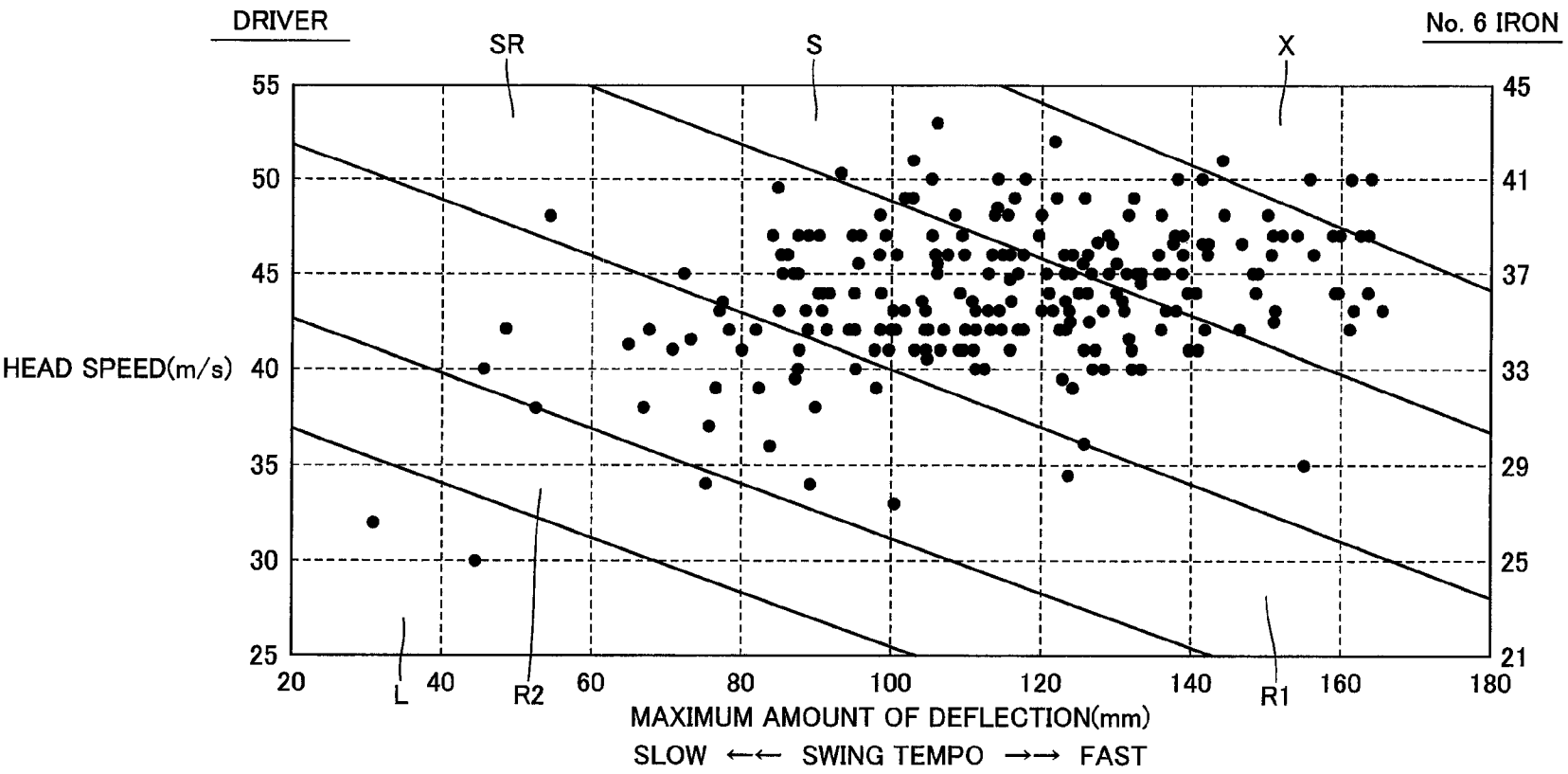
FIG. 22 is a diagram (third chart) representing relation between swing characteristic and preferable flex.

FIG. 22 is a diagram (third chart) representing the relation between the swing characteristic and preferable flex. FIG. 22 shows flexes (X flex (#X), S flex (#S), SR flex (#SR), R1 flex (#R1), R2 flex (#R2), and L flex (#L)) suitable for each golfer. Referring to FIG. 22, for golfers whose head speed is high and swing tempo is high, relatively hard golf club shafts (X flex, S flex) are suitable. For golfers whose head speed is slow and swing tempo is slow, relatively soft golf club shafts (R2 flex, L flex) are suitable.

Figure 23:
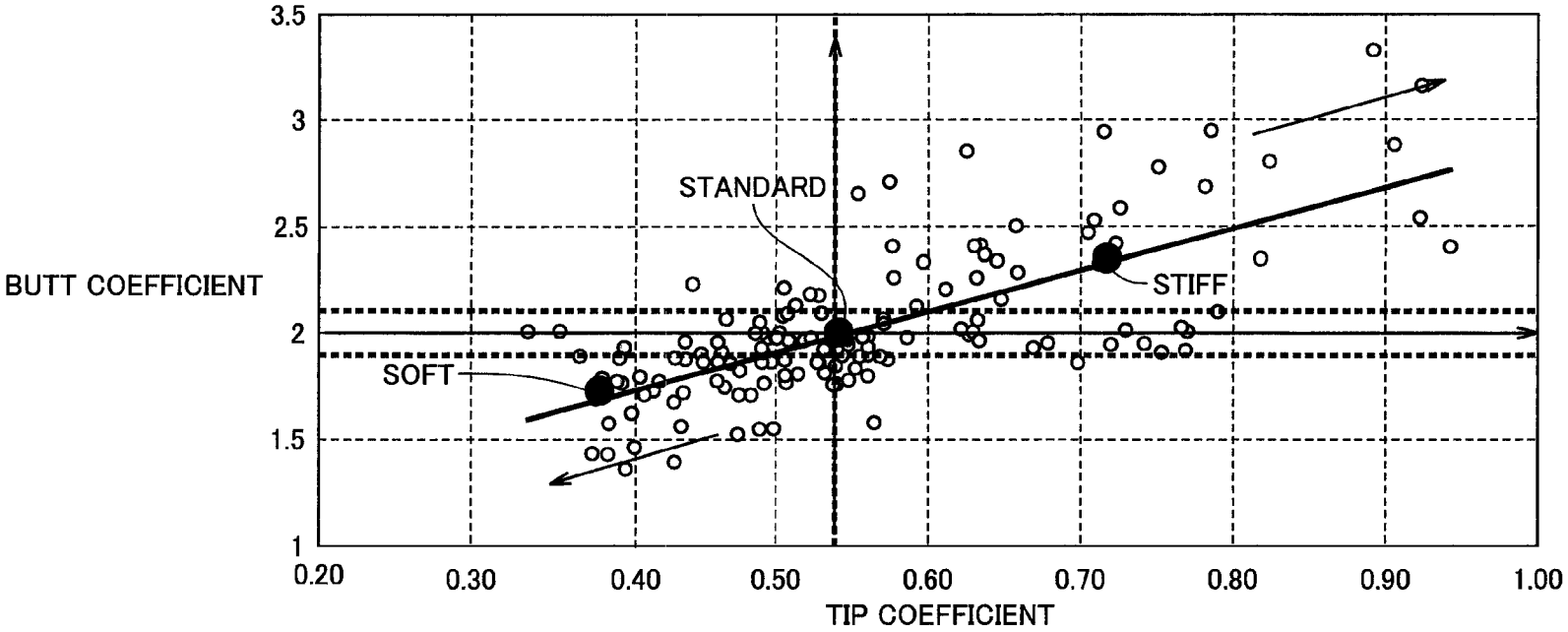
FIG. 23 is a diagram representing a method of classifying shaft bending stiffness distribution.

FIG. 23 is a diagram representing a method of classifying shaft bending stiffness distribution (kick points). The inventors classified kick points (bending stiffness distribution), using the ratio (TIP coefficient) of average bending stiffness at the central portion of shafts with respect to average bending stiffness at the tip end portion of shafts, and the ratio (BUTT coefficient) of the average bending stiffness at the central portion of shafts with respect to average bending stiffness at the grip portion of shafts. Here, average TIP coefficient and BUTT coefficient of club shafts (of about 150 different types) commercially available at present in Japan, the United States and Europe (TIP coefficient: 0.554, BUTT coefficient: 2.0) are used as the origin.

Generally, fluctuation of bending stiffness of 5% or smaller is said to be hard to recognize. Therefore, the range in which BUTT coefficient is about 1.9 to about 2.1 may be classified as the "first category," the range in which TIP coefficient is larger than about 0.54 and BUTT coefficient is larger than about 2.1 may be classified as the "second category", and the range in which BUTT coefficient is smaller than about 1.9 may be classified as the "third category." The "first category" mentioned above corresponds to the range of "butt standard" in which the gripping portion has average hardness (that is, BUTT coefficient is about 1.9 to about 2.1). The "second category" is included in a range in which the gripping portion is relatively hard (that is, BUTT coefficient is larger than about 2.1) and the tip end portion is relatively hard. This range will be referred to as "butt stiff." The "third category" is in the range in which the gripping portion is relatively soft (that is, BUTT coefficient is smaller than about 1.9) and the tip end portion is relatively soft. This range will be referred to as "butt soft."

It is noted that the inventors prepared club shafts of "butt soft," "butt standard," and "butt stiff" of which relations between TIP coefficient and BUTT coefficient are distributed on the average line (for example, "SOFT", "STANDARD" and "STIFF" shown in FIG. 24), as golf club shafts as the objects of selection. By this approach, the BUTT coefficient and TIP coefficient can simultaneously be determined.

Figure 24:
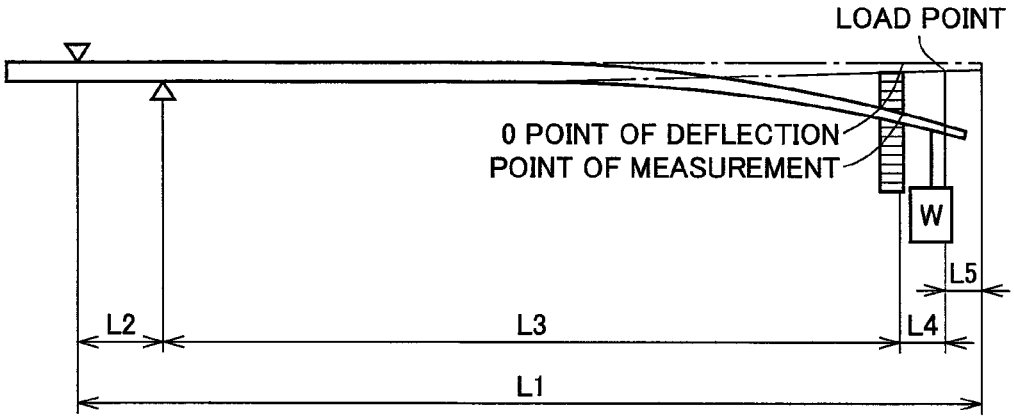
FIG. 24 illustrates a cantilever model.

The samples "SOFT", "STANDARD" and "STIFF" shown in FIG. 23 are designed to show the same amount of deflection in a cantilever model shown in FIG. 24. Club shaft deformation during a swing is much influenced by flexure on the gripping side and, therefore, it can be handled as such a cantilever model as shown in FIG. 24. As described above, the club shafts are adapted to show the same amount of deflection in the cantilever model and, therefore, swing tempo can be evaluated uniformly no matter which club shaft is used for trial. In FIG. 24, L1 represents distance from a gripping side support to the shaft tip end, L2 represents distance between supports, L3 represents distance from a shaft central support to a measuring point, L4 represents measurement point to load point distance, and L5 represents distance from the load point to the shaft tip end, which are, for example, L1=1020 (mm), L2=100 (mm), L3=833 (mm), L4=67 (mm), and L5=20 (mm).

Figure 25:
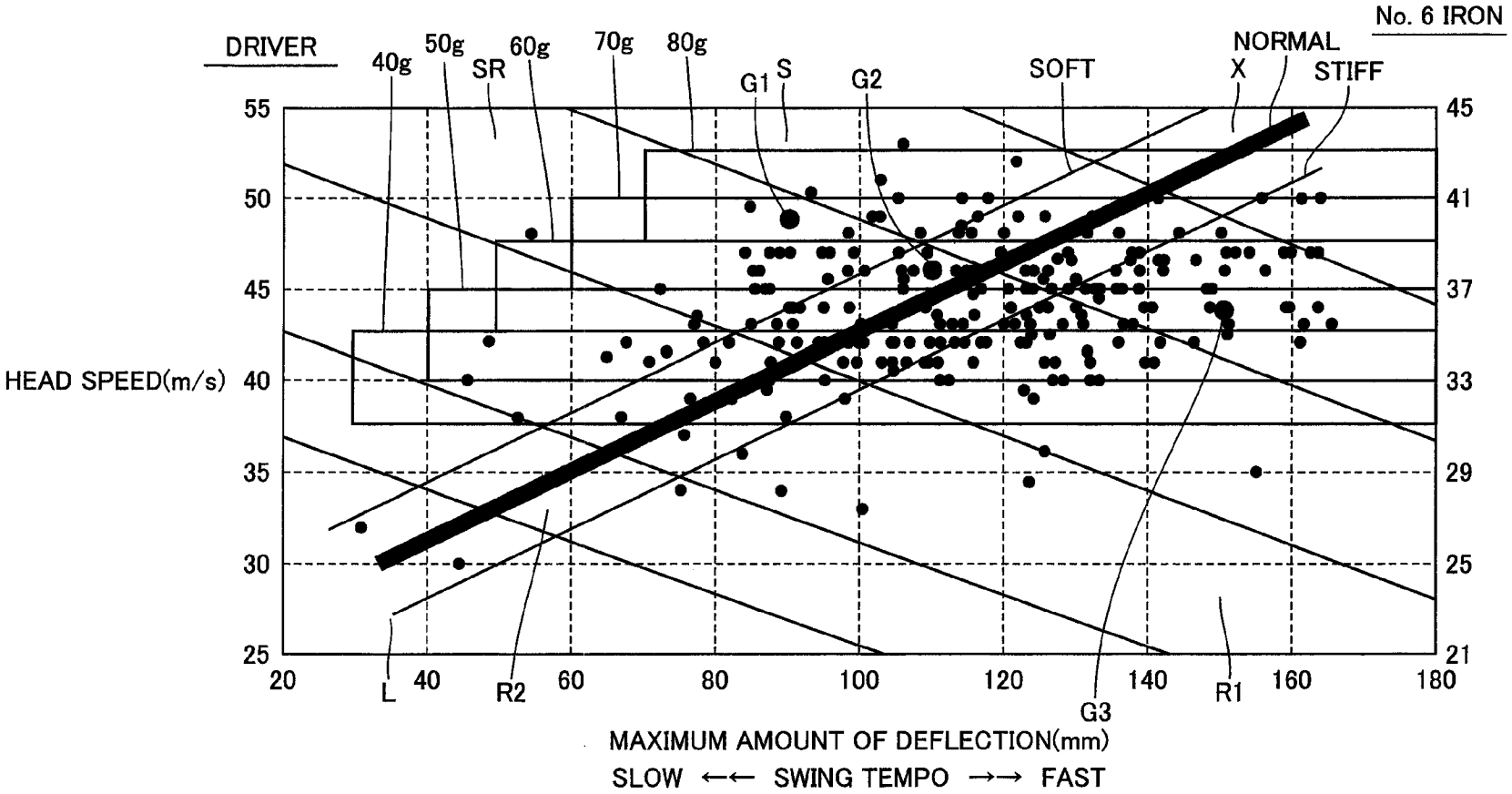
FIG. 25 is a diagram representing relations among swing characteristic, preferable shaft mass, flex and kick point.

FIG. 25 illustrates relations among swing characteristic and preferable shaft mass, flex, and kick point. In FIG. 25, preferable shaft mass (50 g, 60 g, 70 g, 80 g), flex and kick point with respect to the swing characteristic (head speed and swing tempo) are plotted in overlapped manner.

Referring to FIG. 25, for a golfer whose swing characteristic is "G1", 70 g or 80 g is the suitable shaft mass, "SR" is the suitable flex, and "butt soft" is the suitable kick point. Therefore, for this golfer, trial is done using golf clubs having the club shafts 1 and 2 below, and the club shaft having the highest meet SN ratio is selected:

1. Mass: 70 g, flex: SR, kick point: butt soft
2. Mass: 80 g, flex: SR, kick point: butt soft.

Referring to FIG. 25, for a golfer whose swing characteristic is "G2", 60 g or 70 g is the suitable shaft mass, "SR" is the suitable flex, and "butt standard" is the suitable kick point. Therefore, for this golfer, trial is done using golf clubs having the club shafts 1 and 2 below, and the club shaft having the highest meet SN ratio is selected:

1. Mass: 60 g, flex: SR, kick point: butt standard
2. Mass: 70 g, flex: SR, kick point: butt standard.

Further, referring to FIG. 25, for a golfer whose swing characteristic is "G3", 50 g or 60 g is the suitable shaft mass, "S" is the suitable flex, and "butt stiff" is the suitable kick point. Therefore, for this golfer, trial is done using golf clubs having the club shafts 1 and 2 below, and the club shaft having the highest meet SN ratio is selected:

1. Mass: 50 g, flex: S, kick point: butt stiff
2. Mass: 60 g, flex: S, kick point: butt stiff.

As described above, from the head speed and the swing tempo, the shaft mass, flex and bending stiffness distribution can simultaneously be selected.

Table 2 represents types of golf club shafts prepared by the inventors, for realizing golf club shaft selecting method in accordance with the present embodiment.

TABLE 2

| | | Kick Point | | | | | | | | | | | | | | |
|---|---|---|---|---|---|---|---|---|---|---|---|---|---|---|---|---|
| | | Butt Soft | | | | | Butt Standard | | | | | Butt Stiff | | | | |
| | | | | | | | Flex | | | | | | | | | |
| | | R2 | R1 | SR | S | X | R2 | R1 | SR | S | X | R2 | R1 | SR | S | X |
| Mass | 80 g | | | • | • | • | | | | • | • | | | | • | • |
| | 70 g | | | • | • | | | | • | • | • | | | | • | • |
| | 60 g | | • | • | | | | | • | • | | | | • | • | • |
| | 50 g | | • | • | | | | • | • | | | | | • | • | |
| | 40 g | • | • | | | | | • | • | | | | • | • | • | |

•: Prepared club shafts

Figure 26:
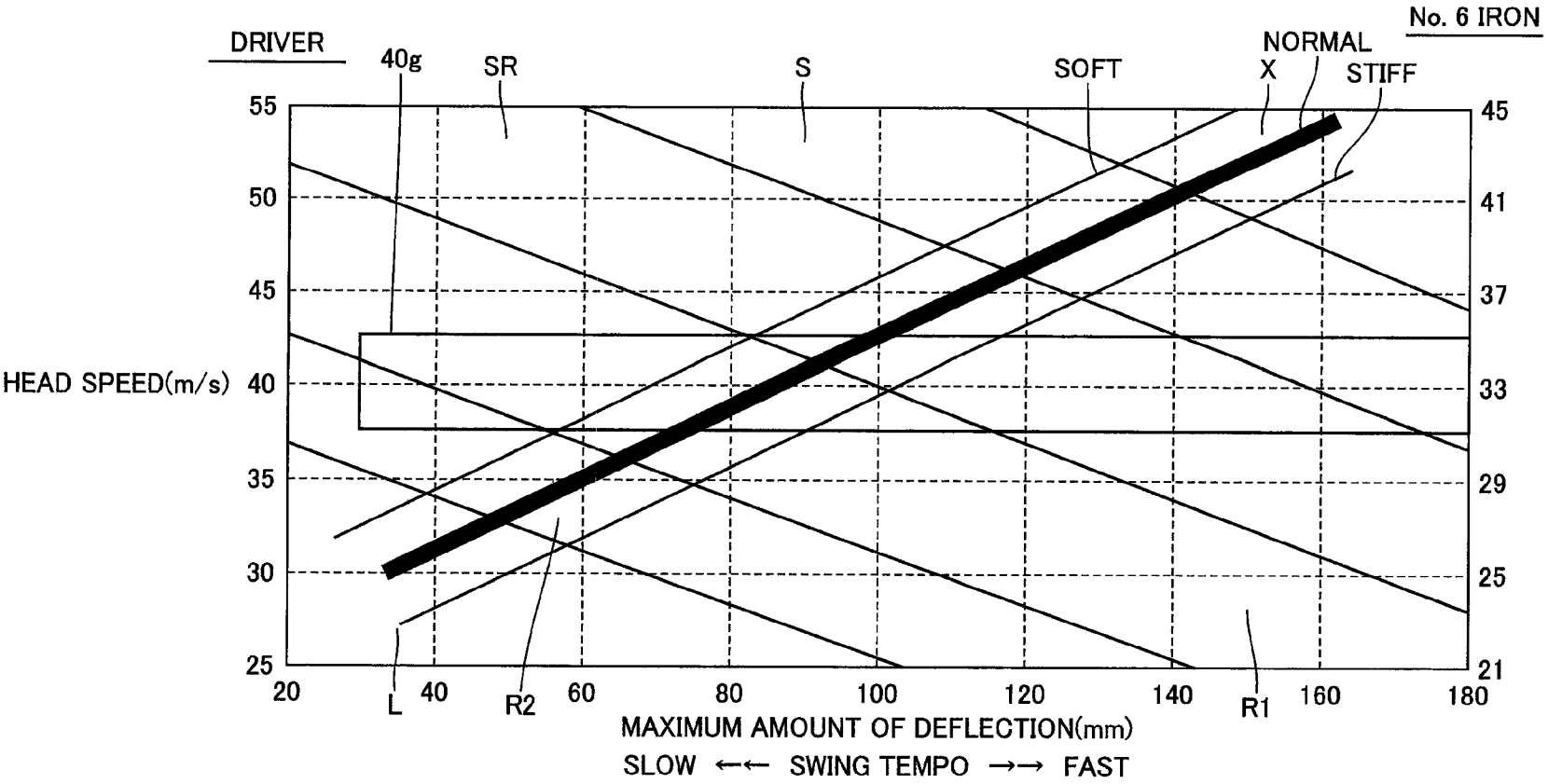
FIG. 26 is a diagram showing suitable range for a shaft of "40 g" and preferable kick point and flex, extracted from FIG. 15.

The types of club shafts necessary for performing the golf club shaft selecting method in accordance with the present embodiment are derived in the following manner. FIG. 26 shows a portion representing the range in which the shaft of "40 g" is suitable, and preferable kick point and preferable flex, extracted from FIG. 25. Referring to FIG. 26, when the shaft mass is 40 g, the range in which "butt soft" is suitable overlaps with the range in which flexes R2 and R1 are suitable, the range in which "butt standard" is suitable overlaps with the range in which flexes R1 and SR are suitable, and the range in which "butt stiff" is suitable overlaps with the range in which flexes R1, SR and S are suitable. Therefore, for the club shaft having the mass of 40 g, what must be prepared are the club shafts of "butt soft" having flexes R2 and R1, club shafts of "butt standard" having flexes R1 and SR, and club shafts of "butt stiff" having flexes R1, SR and S. In this manner, the types of club shafts necessary for performing the golf club shaft selecting method in accordance with the present embodiment can all be found from FIG. 25. By the present embodiment, about 90% of golfers could be covered by preparing the club shafts of the types shown in Table 2.

In designing a golf club shaft, the shaft mass, kick point and flex can be adjusted independent from each other. Therefore, as shown in Table 2, when club shafts of 5 different shaft mass, three different kick points and 5 different flexes are to be prepared, 75 different types of club shafts (=5×3×5) must be prepared. In contrast, according to the present embodiment, by simply preparing a total of 34 types of club shafts (butt soft: 11 types, butt standard: 11 types and butt stiff: 12 types), optimal golf club shafts could be selected for about 90% of the golfers. Further, in the present embodiment, simply by measuring the head speed and swing tempo of each golfer, golf club shafts suitable for each golfer can be narrowed down to a few (for example, two) shafts. As described above, according to the golf club shaft selecting method of the present embodiment, it is possible to appropriately select a club shaft optimal for each golfer, from various types of club shafts. The inventors confirmed that as a result of trials using actually selected plurality of club shafts by respective golfers, at least one of the club shafts attained sufficiently high meet SN ratio.

Although the present invention has been described and illustrated in detail, it is clearly understood that the same is by way of illustration and example only and is not to be taken by way of limitation, the scope of the present invention being interpreted by the terms of the appended claims.

What is claimed is:

1. A golf club shaft selecting system comprising:

a swing analyzer capable of outputting information that can be used for analyzing a swing of a user, comprising: first and second acceleration sensors provided on a swing member swung by a user and having a longitudinal direction, spaced apart by a distance in said longitudinal direction for measuring a virtual speed of the swing member;

a calculating unit comparing the measured virtual speed of the swing member with a table of predetermined actual speeds to obtain an actual speed of a portion of the swing member positioned apart from said first and second acceleration sensors in said longitudinal direction;

a strain gauge attached to said swing member; and a display unit for displaying the actual speed;

wherein, assuming that said swing member is in circular motion during a swing, said calculating unit calculates a virtual speed at said portion based on the distance between said first and second acceleration sensors and calculates the actual speed of said portion utilizing said virtual speed;

wherein said calculating unit calculates the actual speed of said portion by correcting said virtual speed at the time of measurement with predetermined speed correction data stored in said calculating unit;

wherein the predetermined speed correction data is based on an actual measured value from a secondary measuring device;

wherein said calculating unit calculates an amount of deflection of said swing member based on an output from said strain gauge;

wherein said calculating unit stores in advance correction data for approximating said actual speed from said virtual speed based on predetermined data from the secondary measuring device; and wherein said selecting system selects a golf club shaft based on the actual speed of said portion and the amount of deflection of said swing member.

2. The golf club shaft selecting system according to claim 1, further comprising:

an elastically deformable buffer member provided on a circumferential surface of said swing member; and a board provided on said buffer member; wherein said first and second acceleration sensors are provided on a first main surface of said board.

3. The golf club shaft selecting system according to claim 2, wherein said calculating unit and said display unit are provided on a second main surface opposite to said first main surface on which said first and second acceleration sensors are provided.

4. The golf club shaft selecting system according to claim 1, wherein the time of impact is determined by measuring an abrupt change in acceleration in at least a portion of the swing member using one or more of the first and second acceleration sensors.

5. A method for selecting a golf club shaft comprising:

measuring the virtual speed of a swing member using one or more accelerometers mounted thereon;

measuring an amount of deflection of the swing member using one or more strain gauges mounted thereon;

detecting an impact between the swing member and an object using one or more of the first and second acceleration sensors;

calculating the actual speed of the swing member immediately preceding impact by comparing a measured virtual speed of the swing member with a table of predetermined actual speeds with a processor to obtain an actual speed of the swing member; and selecting a golf club shaft based on the actual speed of the swing member immediately preceding the impact and the deflection of the swing member.

6. The method of claim 5, wherein the impact between the swing member and the object is detected by the one or more accelerometers detecting an abrupt change in the acceleration of the swing member.

7. The method of claim 6, wherein the impact between the swing member and the object is detected when the accelerations from two or more accelerometers all fluctuate more than a predetermined amount in a predetermined time.

8. The method of claim 5, further comprising calculating the speed of a head of the swing member based on the speed calculated for the swing member.

9. The method of claim 5, wherein the deflection of the swing member is measured using a first strain gauge mounted on the x-axis of the swing member and a second strain gauge mounted on the y-axis of the swing member.

10. The method of claim 5, further comprising storing one or more swing speeds in a memory.

11. The method of claim 5, wherein a stiffness of the golf club shaft is selected based on the speed of the swing member preceding the impact and the amount of deflection of the swing member.

12. The method of claim 5, wherein one or more of a mass and a kick point of the golf club shaft is selected based on the speed of the swing member preceding the impact and the amount of deflection of the swing member.

13. The method of claim 5, wherein a maximum amount of deflection of the swing member is measured, and one or more of the mass, kick point, and flex of the golf club shaft is selected based on the maximum amount of deflection of the swing member and the speed of the swing member.

14. The system of claim 1, wherein said selecting unit selects the flex of the golf club shaft based on the actual speed of the portion and the amount of deflection of the swing member.

15. The system of claim 1, wherein said selecting unit selects one or more of the mass and kick point of the shaft based on the actual speed of the portion and the amount of deflection of the swing member.

16. The system of claim 1, wherein:

said calculating unit calculates a maximum amount of deflection of the swing member based on the output from said strain gauge; and said selecting unit selects one or more of the mass, kick point, and flex of the shaft based on the actual speed of the portion and the maximum amount of deflection of the swing member.

* * * * *